US009382839B2

(12) United States Patent
Bonner

(10) Patent No.: US 9,382,839 B2
(45) Date of Patent: Jul. 5, 2016

(54) COMBUSTION ENGINE COMPRISING A CENTRAL CAM-DRIVE SYSTEM

(71) Applicant: Jeffrey Bonner, Naples, FL (US)

(72) Inventor: Jeffrey Bonner, Naples, FL (US)

( * ) Notice: Subject to any disclaimer, the term of this patent is extended or adjusted under 35 U.S.C. 154(b) by 154 days.

(21) Appl. No.: 14/224,225

(22) Filed: Mar. 25, 2014

(65) Prior Publication Data

US 2015/0275777 A1 Oct. 1, 2015

(51) Int. Cl.
*F02B 75/04* (2006.01)
*F01B 9/06* (2006.01)

(52) U.S. Cl.
CPC ..... *F02B 75/048* (2013.01); *F01B 9/06* (2013.01)

(58) Field of Classification Search
CPC ..... F02B 75/045; F02B 75/32; F02B 75/04; F02B 75/048; F01B 9/06
USPC ..... 123/172.2, 172.3, 172.4, 78 E, 48 R, 123/48 A, 48 AA, 48 B
See application file for complete search history.

(56) References Cited

U.S. PATENT DOCUMENTS 1,630,273 A 5/1927 Nordwick
1,654,378 A 12/1927 Marchetti
1,790,198 A 1/1931 Cizek
3,998,200 A 12/1976 Sudholt et al.
4,510,894 A * 4/1985 Williams ..... F02B 75/26 123/48 AA
4,545,336 A * 10/1985 Waide ..... F01B 9/06 123/54.3
5,454,352 A * 10/1995 Ward ..... F01B 9/047 123/197.1
6,125,802 A * 10/2000 Pen ..... F02B 75/048 123/197.4
6,347,610 B1 * 2/2002 Norton ..... F01B 9/06 123/197.4
6,976,467 B2 * 12/2005 Fantuzzi ..... F01B 9/06 123/197.1
7,328,682 B2 2/2008 Fisher
8,720,393 B2 * 5/2014 Tsay ..... F01B 9/06 123/192.1
2001/0017122 A1 * 8/2001 Fantuzzi ..... F01B 9/06 123/197.4
2002/0007814 A1 * 1/2002 Mansur ..... F01B 9/06 123/197.1
2011/0277732 A1 11/2011 Tsay et al.

FOREIGN PATENT DOCUMENTS

RU 2298679 C1 5/2007

* cited by examiner

*Primary Examiner* — Marguerite McMahon
*Assistant Examiner* — Tea Holbrook
(74) *Attorney, Agent, or Firm* — Allen D. Hertz, P.A.; Allen D. Hertz

(57) ABSTRACT

A drive cam operated combustion engine comprising at least one cylinder, each cylinder having a power conversion assembly. Each power conversion assembly includes a piston slideably assembled with a cylinder, a drive cam assembly having at least one drive cam, a piston control rocker arm assembly (including a piston control arm and a piston return arm), and a connecting rod. The drive cam oscillates the rocker arm assembly, which positions the piston through the connecting rod. The rocker arm assembly oscillation driving the piston upwards during a compression stroke and an exhaust stroke, and draws the piston downward during an intake stroke. A combustion episode during a combustion stroke introduces power into the system, which is transferred from the engine by an output shaft. The drive cam assembly can include a primary drive cam and a secondary drive cam for each rocker arm assembly.

26 Claims, 35 Drawing Sheets

COMBUSTION ENGINE COMPRISING A CENTRAL CAM-DRIVE SYSTEM

FIELD OF THE INVENTION

The present invention relates to a combustion engine, and more particularly, a combustion engine comprising a central drive cam assembly in operable communication with a piston through a rocker arm assembly and connecting rod.

BACKGROUND OF THE INVENTION

The primary operating components of combustion engines have remained the same over many years, wherein the combustion engine utilizes a crankshaft in operable communication with a piston through a connecting rod. The crankshaft includes a series of "bearing journals", a series of "crank throws" or "crankpins", and a series of "counterweights". The crankshaft is assembled to an engine block by seating each of the series of bearing journals within replaceable main bearings retained within a crankcase of an engine block. The bearing journals define a linear axis or axis of rotation. The crankpins are additional bearing surfaces whose axis is offset from that of the crankshaft. The smaller end of each connecting rod is rotationally attached to a wrist pin assembled to each respective piston. The larger end of each connecting rod is rotationally attached to the respective crankpin.

The efficiency of the engine is limited by the geometric limitations of the design. The connecting rods oscillate as the crankshaft rotates. The oscillation is generated by an offset between the crankpin and the bearing journals or the crankshaft axis of rotation. For example, the longer the connecting rod, the smaller the angle between a normal force provided upon a combustion surface of each piston and a central axis of each respective connecting rod during a combustion or power stroke of an engine cycle. The smaller the angle the more efficient the transfer of force. Two factors affect a torque applied to the crankshaft. The first is the applied force. The second is a lever arm distance, wherein the lever arm distance extending perpendicularly between a central axis of the connecting rod and the central point of rotation of the crankshaft.

The applied force is the result of the combustion chamber pressure applied to the combustion surface of each piston during combustion of the fuel. The applied force is the component of the normal compression force running parallel to the central axis of the connecting rod. There exists an angle between the centerline of the bore and the centerline of the connecting rod, wherein the angle at any moment of time is a function of the crankshaft angle at the same moment during the rotation. The shorter the connecting rod, the greater the angle. Additionally, the greater the resulting lever arm distance, the greater the resulting torque output.

Accordingly, there remains a need in the art for a more efficient combustion engine by overcoming the geometric limitations imposed by current piston driven combustion engine configurations that utilize a combination of a piston, a connecting rod, and a crankshaft.

SUMMARY OF THE INVENTION

The present invention overcomes the deficiencies of the known art by disclosing a design and configuration of components and an associated method of use of the configuration within a piston driven combustion engine.

In accordance with one embodiment of the present invention, the invention consists of a combustion engine comprising:

a piston slideably assembled within a cylinder chamber of an engine block;

a central drive cam assembly comprising at least one drive cam, each of the at least one drive cam comprises a peripheral cam surface geometrically defined about a rotational axis, each cam being assembled to a rotational bearing shaft, the rotational bearing shaft being rotationally assembled to the engine block by a support element;

a piston control rocker arm assembly comprising a piston control arm and a piston return arm, wherein the piston control arm and the piston return arm are joined having an angular relation therebetween; and a connecting rod in operational communication between the piston and the piston control arm;

wherein the piston control arm is in communication with the peripheral cam surface in an arrangement driving the piston control arm upwards as a radial distance of a piston control arm contacting portion of the cam increases during rotation;

wherein the piston return arm is in communication with said cam peripheral cam surface in an arrangement driving the piston control arm downwards as a radial distance of a piston return arm contacting portion of the cam increases during rotation.

In a second aspect, the peripheral cam surface can be shaped to maintain a position of the piston in at least one of:

at top dead center (TDC) over a prolonged period of time, and at bottom dead center (BDC) over a prolonged period of time.

In another aspect, the peripheral cam surface can be asymmetrically shaped providing one of:

an upward motion of piston during a rotational motion of the central drive cam assembly that is greater than 180° and the respective downward motion of the piston during a rotational motion of the central drive cam assembly that is less than 180°, or an upward motion of piston during a rotational motion of the central drive cam assembly that is less than 180° and the respective downward motion of the piston during a rotational motion of the central drive cam assembly that is greater than 180°.

In yet another aspect, the rotational axis of the central drive cam assembly can be offset from a central sliding axis of the piston.

In yet another aspect, the rotational axis of the central drive cam assembly is offset from a central sliding axis of the piston.

In yet another aspect, the rotational axis of the central drive cam assembly can be located towards a pivot location of the piston control rocker arm assembly.

In yet another aspect, the connecting rod is pivotally assembled to the piston by a wrist or connecting pin.

In yet another aspect, the connecting rod is pivotally assembled to the piston control arm.

In yet another aspect, the connecting rod is pivotally assembled to a distal upper end of the piston control arm.

In yet another aspect, the piston control rocker arm assembly further comprises at least one roller bearing, wherein the at least one roller bearing is located to rollably contact the peripheral cam surface.

In yet another aspect, the piston control rocker arm assembly further comprises a pair of roller bearings, wherein a first roller bearing of the pair of roller bearings is rotationally assembled to a distal end of the piston control arm and a second roller bearing of the pair of roller bearings is rotationally assembled to a distal end of the piston return arm, wherein each of the pair of roller bearings are located to rollably contact the peripheral cam surface.

In yet another aspect, central drive cam assembly comprises a primary drive cam and a secondary drive cam.

In yet another aspect, central drive cam assembly comprises a primary drive cam and a secondary drive cam, wherein the piston control arm is in operable communication with the primary drive cam and the piston return arm is in operable communication with the secondary drive cam.

In yet another aspect, central drive cam assembly comprises a primary drive cam and a secondary drive cam, wherein the primary drive cam and a secondary drive cam are axially offset from one another, wherein the piston control arm and the piston return arm are axially offset from one another, wherein the piston control arm is in operable communication with the primary drive cam and the piston return arm is in operable communication with the secondary drive cam.

In yet another aspect, the combustion engine further comprising a cylinder head.

In yet another aspect, the combustion engine further comprises a cylinder head, wherein the cylinder head includes elements providing sealable fuel intake ports and exhaust discharge ports.

In yet another aspect, the central drive cam assembly further comprises at least one counterweight.

In yet another aspect, the central drive cam assembly further comprises at least one counterweight providing counterbalancing for the primary drive cam and the secondary drive cam.

In yet another aspect, the central drive cam assembly further comprises a pair of counterweights, each counterweight providing counterbalancing for each of the primary drive cam and the secondary drive cam, respectively.

In yet another aspect, the piston control rocker arm assembly further comprises at least one counterweight.

In yet another aspect, the piston control rocker arm assembly further comprises at least one counterweight providing counterbalancing for the piston control arm and the piston return arm.

In yet another aspect, the piston control rocker arm assembly further comprises a pair of counterweights, each counterweight providing counterbalancing for each of the piston control arm and the piston return arm, respectively.

In yet another aspect, the piston control rocker arm assembly further comprises a clearance in at least one of the piston control arm and the piston return arm enabling passage of the respective drive cam.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Figure 1:
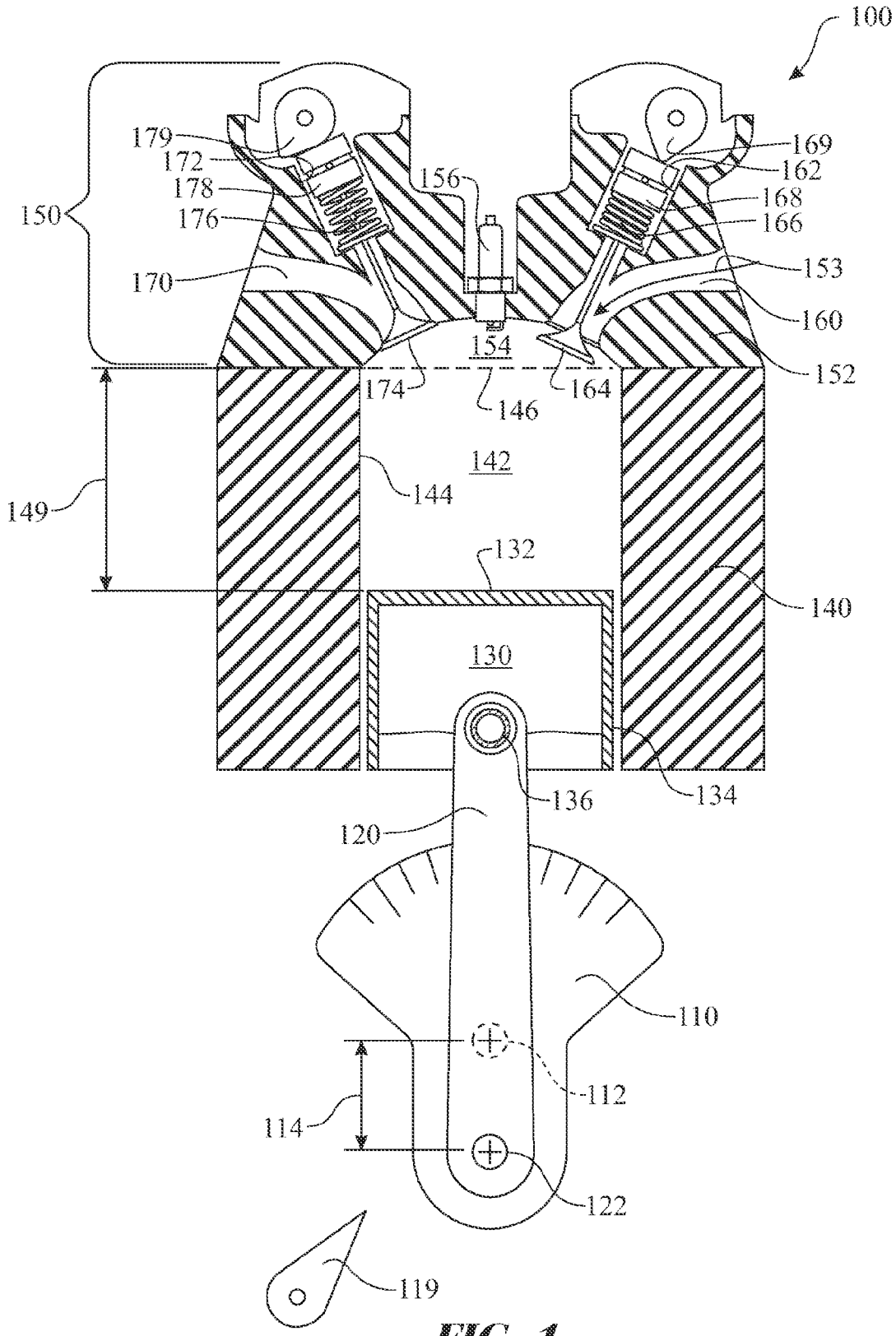
FIG. 1 presents a partially sectioned view of a first exemplary combustion engine, wherein the engine comprises a long connecting rod and is illustrated in a bottom dead center (BDC) rotational position.

For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 9:
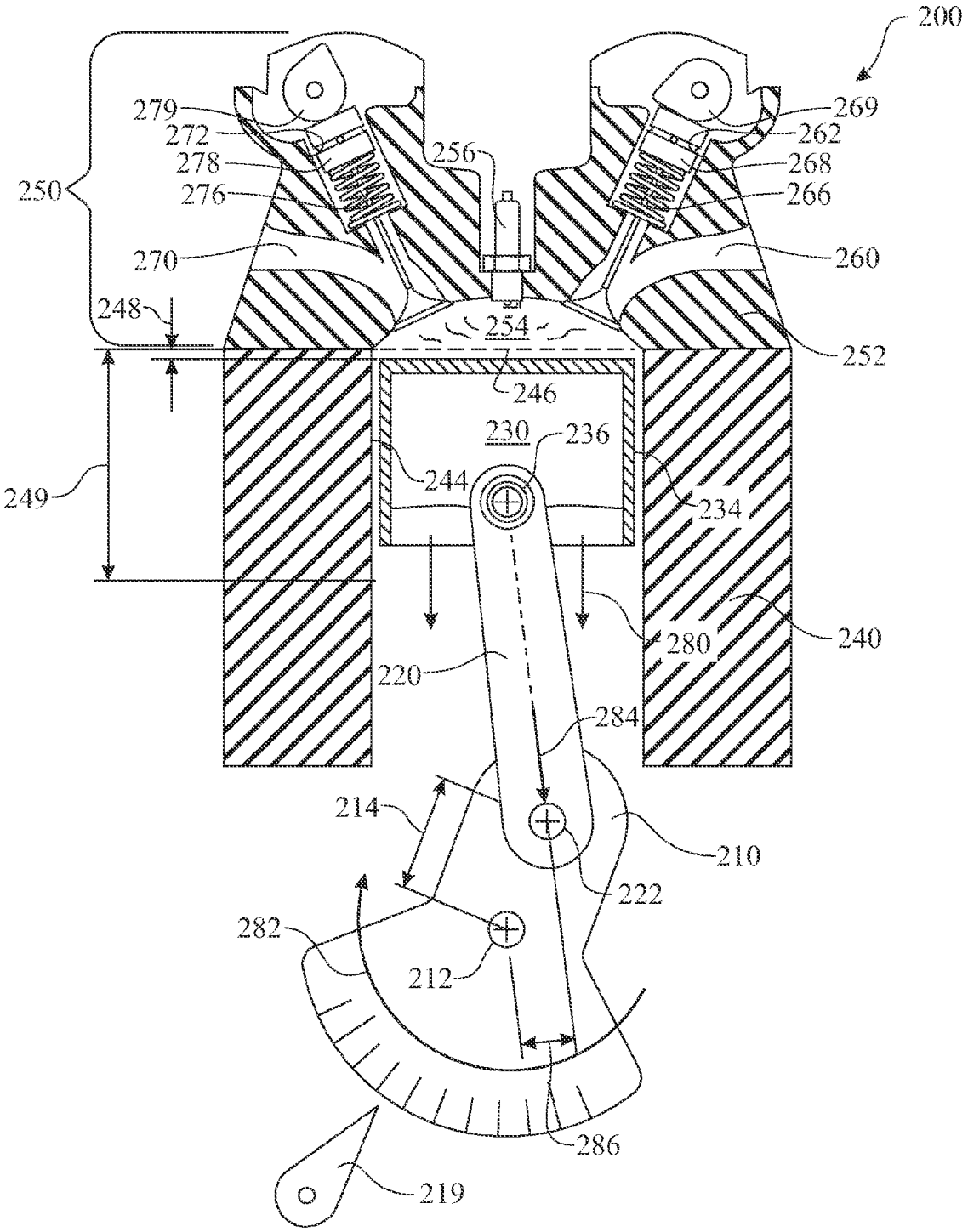
FIG. 9 presents a partially sectioned view of a second exemplary combustion engine, wherein the engine comprises a short connecting rod and is illustrated in a rotational position slightly forward of top dead center (TDC) at initialization of the power stroke.
Figure 10:
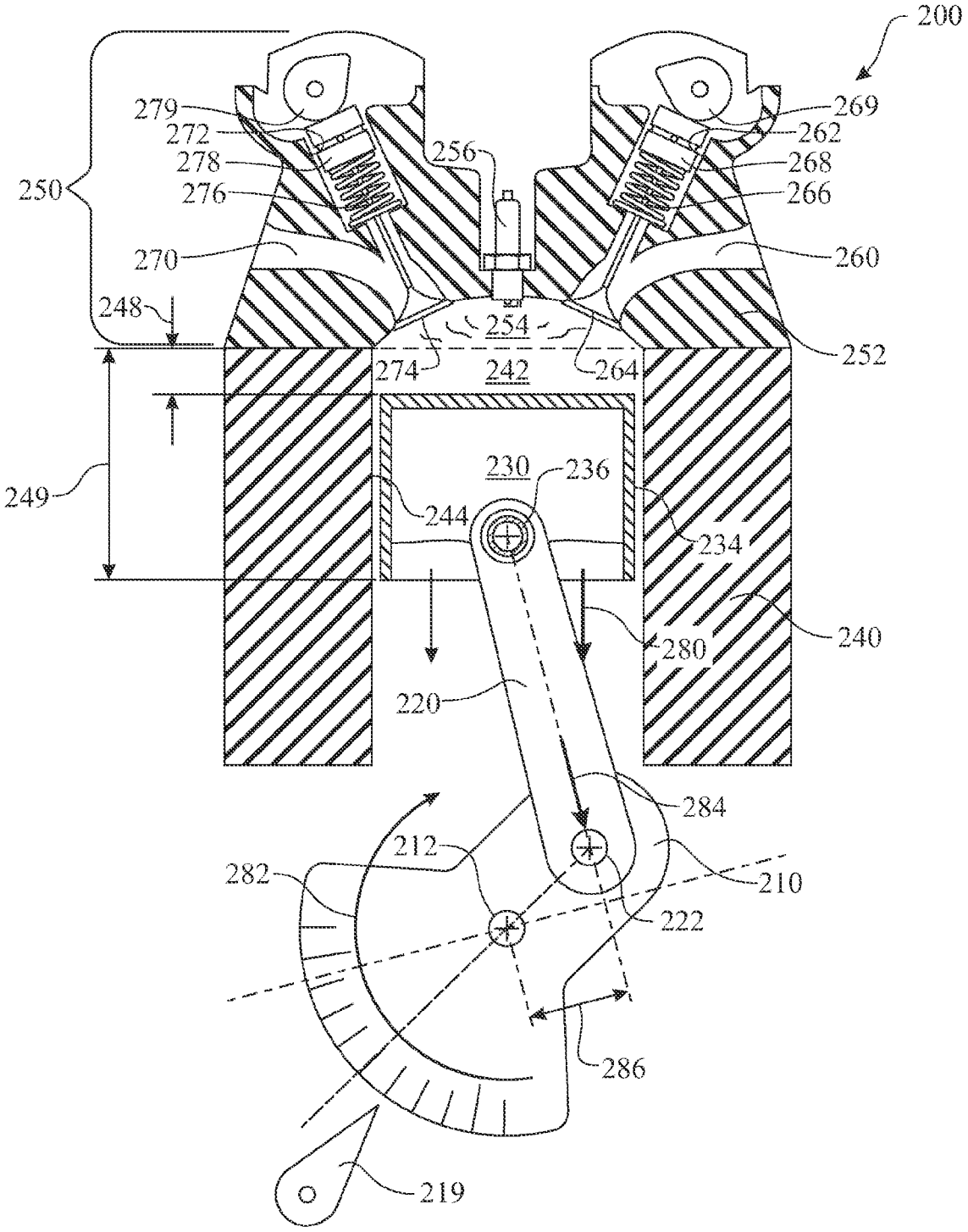
FIG. 10 presents a partially sectioned view of the combustion engine originally introduced in FIG. 9, wherein the engine is illustrated in a rotational position approximately 45° forward of top dead center (TDC) during the power stroke.
Figure 11:
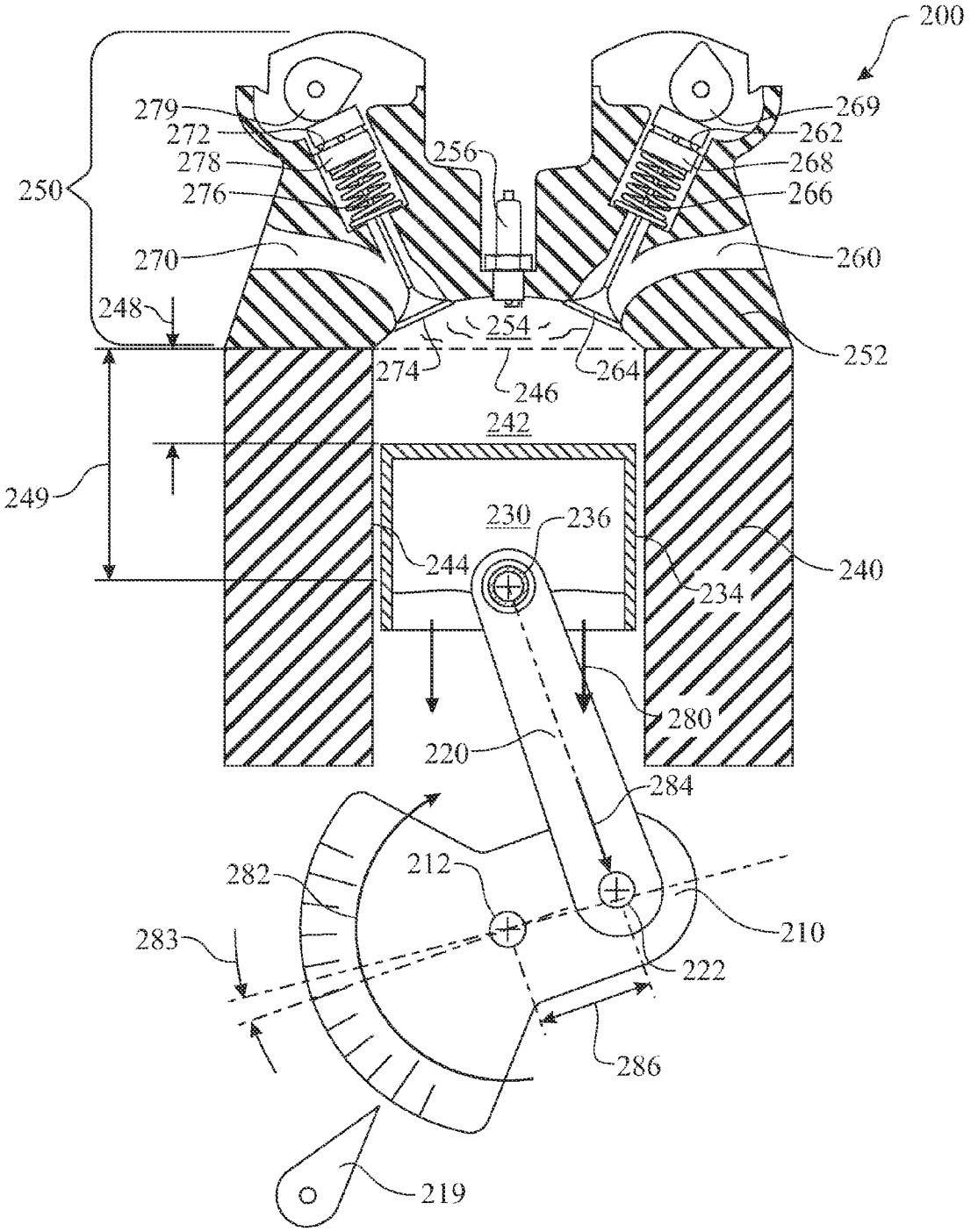
FIG. 11 presents a partially sectioned view of the combustion engine originally introduced in FIG. 9, wherein the engine is illustrated in a rotational position approaching 90° forward of top dead center (TDC) during the power stroke.

Combustion engines are commonly employed for providing power to vehicles. Combustion engines are designed using one of two configurations: a piston driving a crankshaft and a pistonless Wankel rotary engine (generally limited to a MAZDA RX-7 and RX-8). The standard crankshaft-based engine includes inherent limitations. A long connecting rod combustion engine 100, as illustrated in FIGS. 1-6 and a short connecting rod combustion engine 200, as illustrated in FIGS. 9-11, described the components of exemplary crankshaft-based engines. More specifically, the long connecting rod combustion engine 100 describes the components and operational motion of an exemplary crankshaft-based engine having a 3.0" stroke and a long, 5.7" connecting rod 120, whereas the short connecting rod combustion engine 200 describes the components and operational motion of an exemplary crankshaft-based engine having a 3.0" stroke and a short, 1.8" connecting rod 220. Like features of the short connecting rod combustion engine 200 and the long connecting rod combustion engine 100 are numbered the same except preceded by the numeral "2".

Many factors can impact an engine's power optimization and/or efficiency. For example. a rod length of a connecting rod 120, 220 and stroke length 114, 214 defined by a crankshaft 110, 210 are independent variables. The rod length is expressed as center-to-center (c/c) length between the connecting pin 136, 236 and the crankpin 122, 222. An engine 100, 200 with a particular stroke 114, 214 can be fitted with connecting rods 120, 220 of several c/c lengths by changing the piston pin 136, 236 location or block deck height 146, 246. A connecting rod 120 that is longer in relation to stroke 114 causes the piston 130 to dwell a longer time at top dead center (TDC) and causes the piston 130 to move toward and away from top dead center (TDC) more slowly. Long rod engines 100 with a particular stroke 114 also build suction above the piston 130 with less force, since the piston 130 moves away from top dead center (TDC) 146 more slowly.

Figure 13:
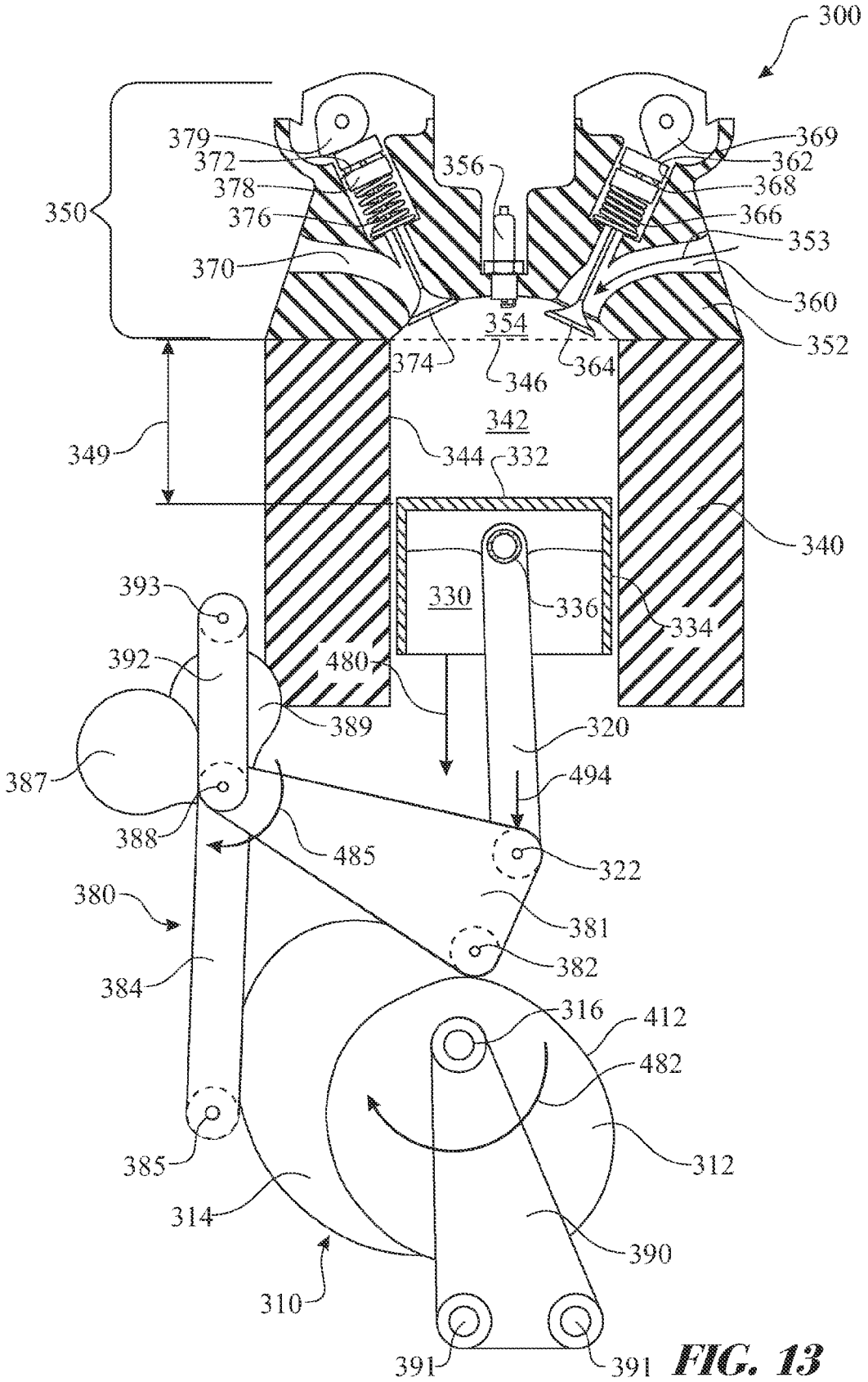
FIG. 13 presents a partially sectioned view of an exemplary drive cam operated combustion engine, wherein the engine is illustrated in a rotational position approaching bottom dead center (BDC)

Consequently, long rod engines 100 tend to produce a lower port air velocity, which also reduces low speed torque. Long rods 130 place less thrust load on the cylinder walls 144, thus generate less parasitic drag and result in less frictional losses as engine revolutions rise. A "short rod" engine 200 has the opposite characteristics. "The short rod 220 exerts more force to the crank pin 122 at any crank angle. Short rod engines 200 tend to develop more torque at lower engine speeds with torque and horsepower falling off as engine RPM rises to high levels. Long rod engines 100 generally produce more power at high revolutions per minute (RPM) due to reduced engine drag, especially as engine RPM increases. Additionally, the short rod 220 exerts more force to the crank pin 122 at any crank angle, but places a higher thrust load on the cylinder wall 144. Regardless of rod length for a given stroke 114, 214, the average piston speed (usually expressed in ft/s or m/s) remains the same. What changes as the rod length becomes shorter or longer in relation to the stroke 114, is the rate of motion as the piston 130 rises and falls in relation to top dead center (TDC). A long rod 120 fitted to a given stroke 114 generates less stress on the component parts due to the lower rate of acceleration away from and toward top dead center (TDC). The average piston speed is the same; however, the peak piston speed is lower with long rods 120. A drive cam operated combustion engine 300 (introduced in FIG. 13), as described later in this disclosure, combines the optimal features of the long connecting rod 120 and the short connecting rod 220 into a single combustion engine.

An engine block 140 provides the primary structural frame of the long connecting rod combustion engine 100. The primary components of the long connecting rod combustion engine 100 include a piston 130 operationally connected to a crankshaft 110 by a connecting rod 120. The crankshaft 110 is designed about a rotational axis defined by a series of bearing journals. The series of bearing journals 112 are seated within replaceable main bearings (not shown) retained within a crankcase of the engine block 140. The bearing journals 112 defining the linear axis or the axis of rotation. The crankshaft 110 additionally includes crankpins 122, which are additional bearing surfaces whose axis is offset from that of the crankshaft rotational axis 112. The distance between the bearing journals 112 and the crankpins 122 is referred to as a crankshaft connecting rod throw 114, which defines a piston stroke 149.

The piston 130 is slideably assembled within a cylinder chamber 142 formed within the engine block 140. The piston 130 is generally cylindrically shaped and slideably assembled within a cylinder chamber 142 of the engine block 140 further comprising sealing elements, such as cylinder rings providing a sealable configuration. The sealing features provide compression for the combustion process. The piston 130 includes a cylindrical piston sidewall 134 sized to slideably and sealingly engage with a cylinder chamber sidewall 144 of the cylinder chamber 142. A piston combustion surface 132 extends across an upper surface of the piston 130. The piston combustion surface 132 defines the combustion generated force receiving surface of the piston 130 during a combustion process.

The connecting rod 120 provides operational communication between the piston 130 and the crankshaft 110. The connecting rod 120 is commonly designed having a smaller end and a larger end. The smaller end is commonly rotationally assembled to the piston 130 using a wrist pin or a connecting pin 136. The larger end is commonly rotationally assembled to the crankpin 122 of the crankshaft 110 integrating a bearing therebetween.

The position of the piston 130 within the cylinder chamber 142 defines the cycle of the engine. The position is commonly referenced by an angle of rotation of the crankshaft 110. The angle can be determined using a timing marker 119 in conjunction with indicators (shown as scribe lines on the crankshaft 110).

A cylinder head assembly 150 is assembled to a distal end of the engine block 140. The cylinder head assembly 150 provides the pre-combustion fuel supply and post-combustion exhaust discharge control systems. The cylinder head assembly 150 includes an intake section and an exhaust section. A combustion chamber 154 is shaped into a cylinder head 152, wherein the shape of the combustion chamber 154 in conjunction with a relative position of the piston combustion surface 132 defines a total exposed volume for combustion. The combustion chamber 154 provides a portion or all of the clearance for motion of the valves 164, 174.

The intake section includes at least one intake port 160, which is toggled between an intake flow and a sealed configuration by cycling an intake valve 164. Cycling of the intake valve 164 is accomplished by rotation of an intake valve cam lobe 169 of an associated camshaft. An intake valve tappet 168 is slideably assembled within an intake valve slot 162 between the intake valve 164 and the intake valve cam lobe 169. A peripheral edge of the intake valve cam lobe 169 is shaped to include a lobe. As the intake valve cam lobe 169 rotates, the lobe applies and removes a biasing force against the intake valve tappet 168. The biasing force applied to the intake valve tappet 168 drives the intake valve 164 into an open position during the intake cycle. An intake valve spring 166 provides a resistance force to the intake valve tappet 168, ensuring the intake valve tappet 168 maintains contact with the intake valve cam lobe 169. The intake valve spring 166 additionally returns and maintains the intake valve 164 in a closed or sealed position during the rotational phase of the intake valve cam lobe 169, where the lobe is not contacting the intake valve tappet 168. The shape of the lobe defines the speed, timing and duration in which the intake valve 164 is placed in the open position. A fuel and air flow 153 passes through the intake port 160 when the intake valve 164 is located in an open position as illustrated in FIG. 1. The fuel and air flow 153 can be supplied using any suitable intake element, including a carburetor, a fuel injection system, and the like. The fuel intake system can be enhanced with the inclusion of a supercharger, a turbo charger, a nitrous-oxide injection system, and the like.

Figure 6:
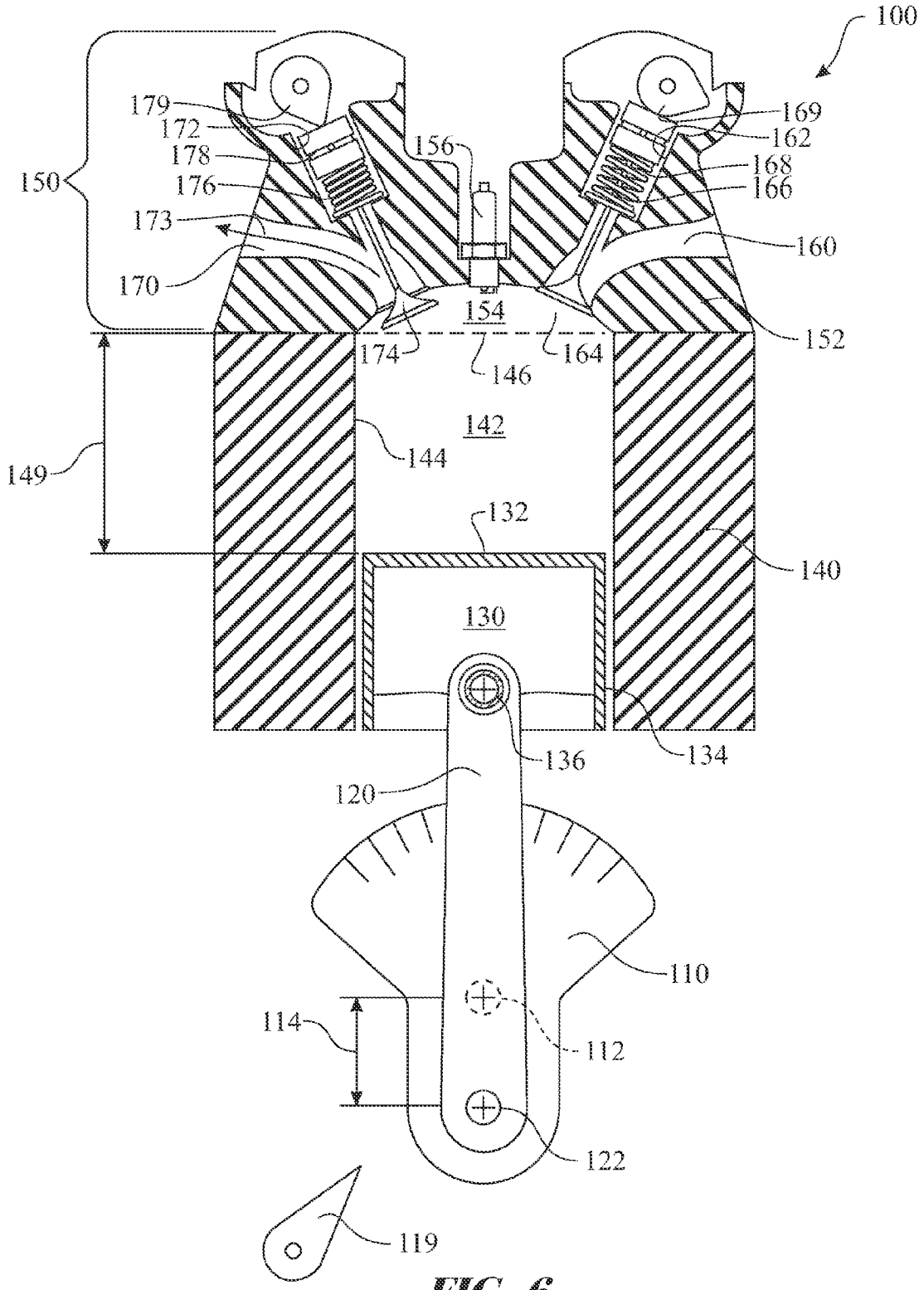
FIG. 6 presents a partially sectioned view of the combustion engine originally introduced in FIG. 1, wherein the engine is illustrated in a bottom dead center (BDC) rotational position.

The exhaust section includes at least one exhaust port 170, which is toggled between an exhaust flow and a sealed configuration by cycling an exhaust valve 174. Cycling of the exhaust valve 174 is accomplished by rotation of an exhaust valve cam lobe 179 of an associated camshaft. An exhaust valve tappet 178 is slideably assembled within an exhaust valve slot 172 between the exhaust valve 174 and the exhaust valve cam lobe 179. A peripheral edge of the exhaust valve cam lobe 179 is shaped to include a lobe. As the exhaust valve cam lobe 179 rotates, the lobe applies and removes a biasing force against the exhaust valve tappet 178. The biasing force applied to the exhaust valve tappet 178 drives the exhaust valve 174 into an open position during the exhaust cycle. An exhaust valve spring 176 provides a resistance force to the exhaust valve tappet 178, ensuring the exhaust valve tappet 178 maintains contact with the exhaust valve cam lobe 179. The exhaust valve spring 176 additionally returns and maintains the exhaust valve 174 in a closed or sealed position during the rotational phase of the exhaust valve cam lobe 179, where the lobe is not contacting the exhaust valve tappet 178. The shape of the lobe defines the speed, timing and duration in which the exhaust valve 174 is placed in the open position. An exhaust flow 173 passes through the exhaust port 170 when the exhaust valve 174 is located in an open position as illustrated in FIG. 6. The exhaust flow 173 can be vented or discharged through any suitable exhaust element, such as an exhaust manifold, headers, individual exhaust pipes, and the like.

Figure 2:
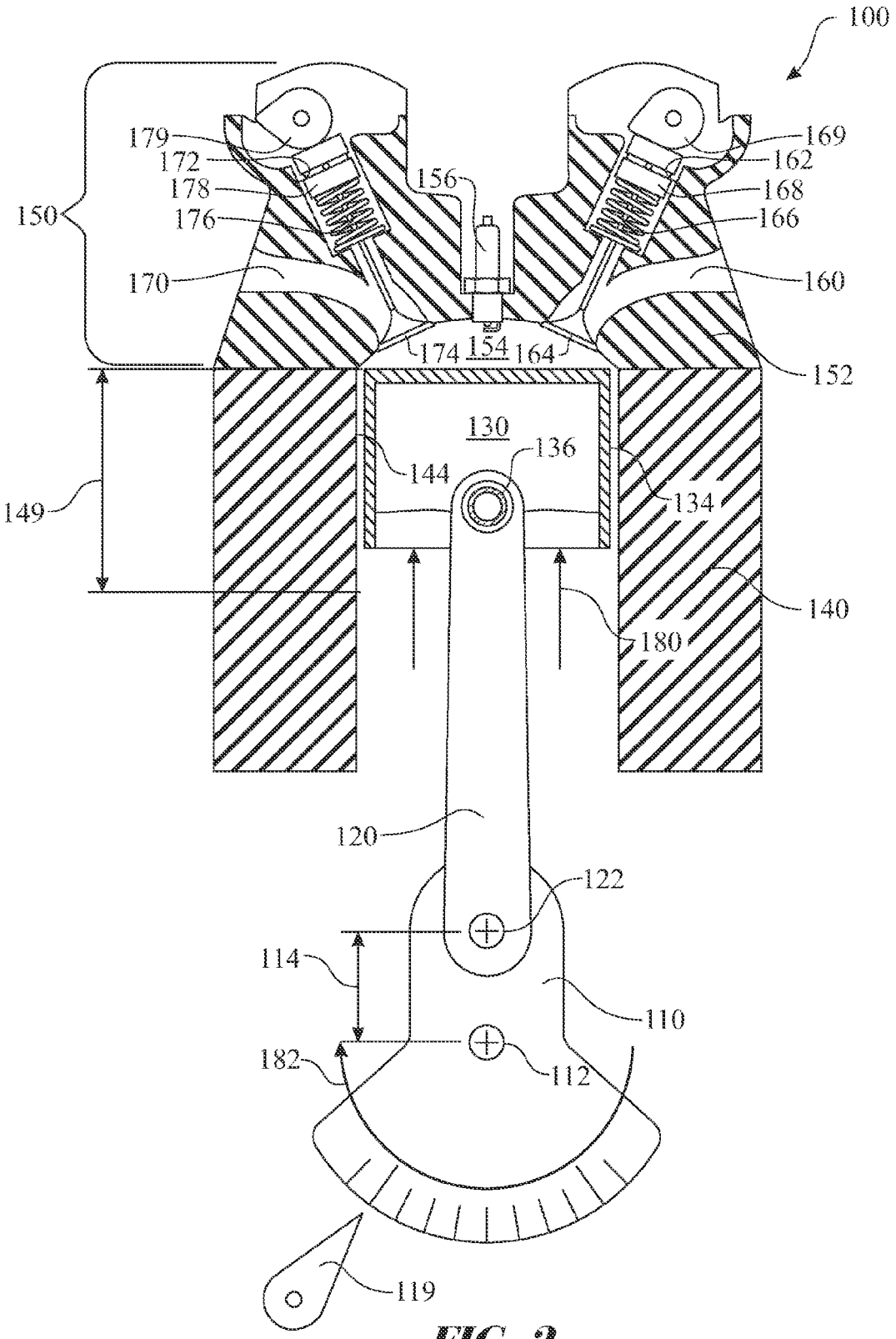
FIG. 2 presents a partially sectioned view of the combustion engine originally introduced in FIG. 1, wherein the engine is illustrated in a top dead center (TDC) rotational position.
Figure 3:
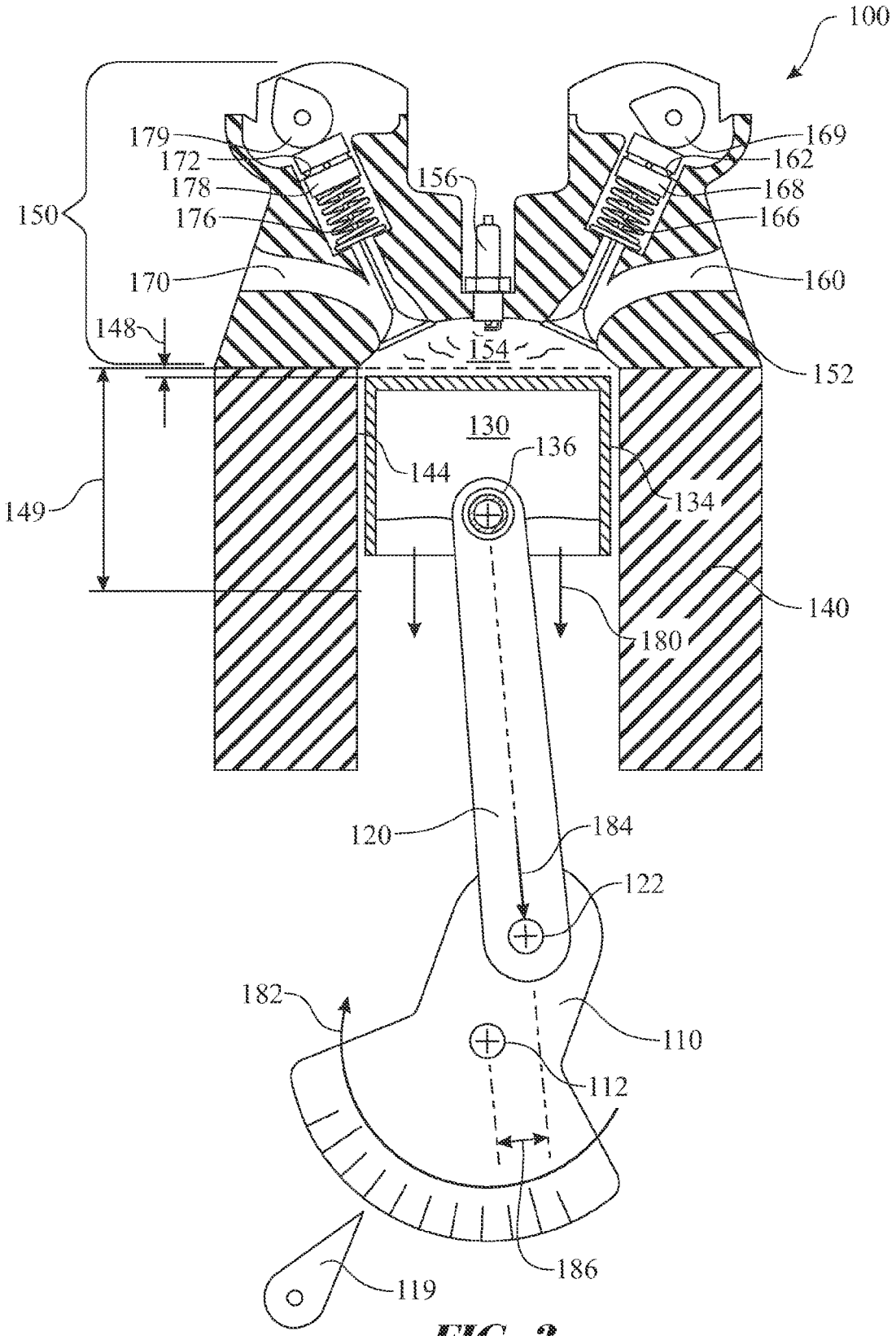
FIG. 3 presents a partially sectioned view of the combustion engine originally introduced in FIG. 1, wherein the engine is illustrated in a rotational position slightly forward of top dead center (TDC) at initialization of the power stroke.
Figure 4:
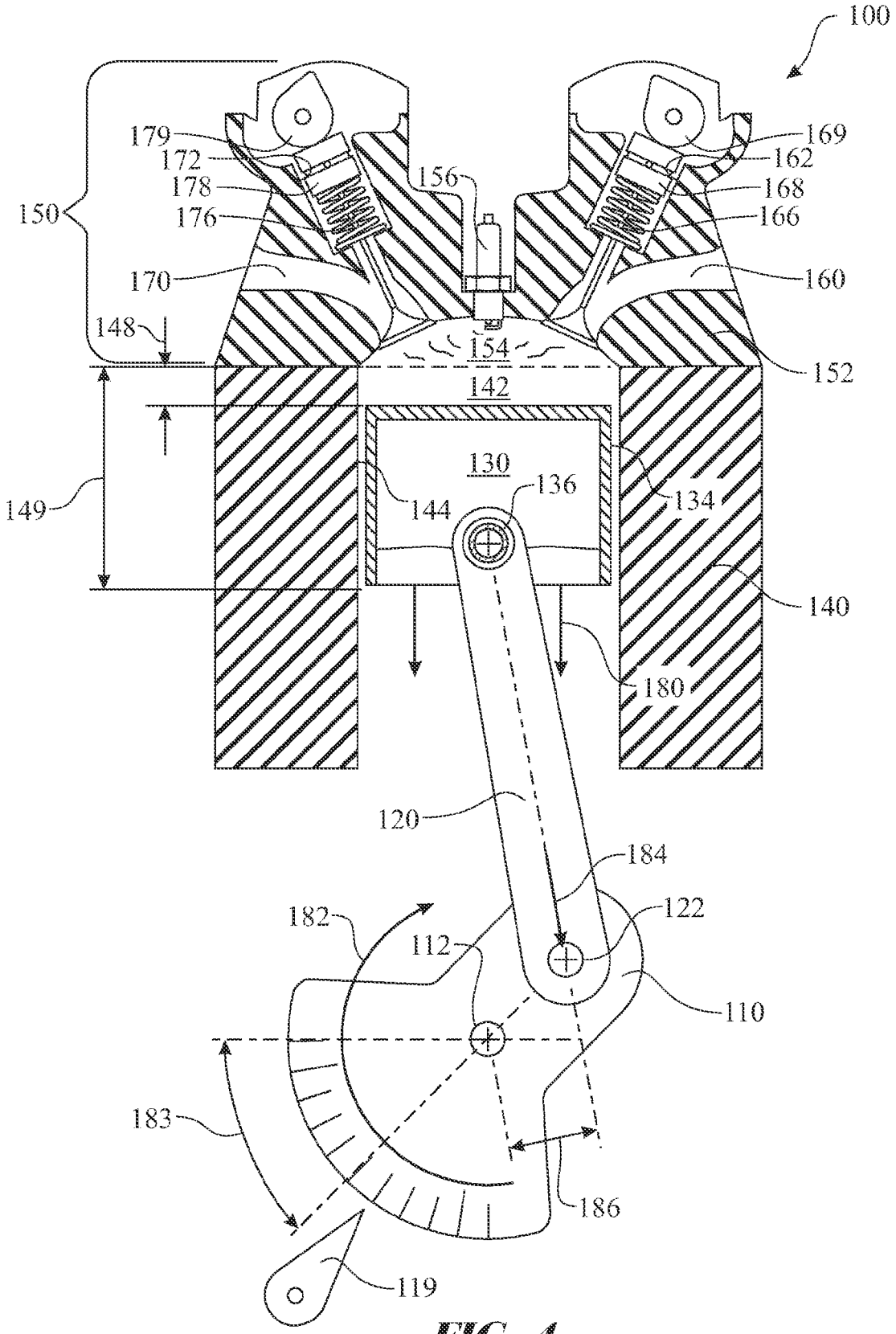
FIG. 4 presents a partially sectioned view of the combustion engine originally introduced in FIG. 1, wherein the engine is illustrated in a rotational position approximately 45° forward of top dead center (TDC) during the power stroke.
Figure 5:
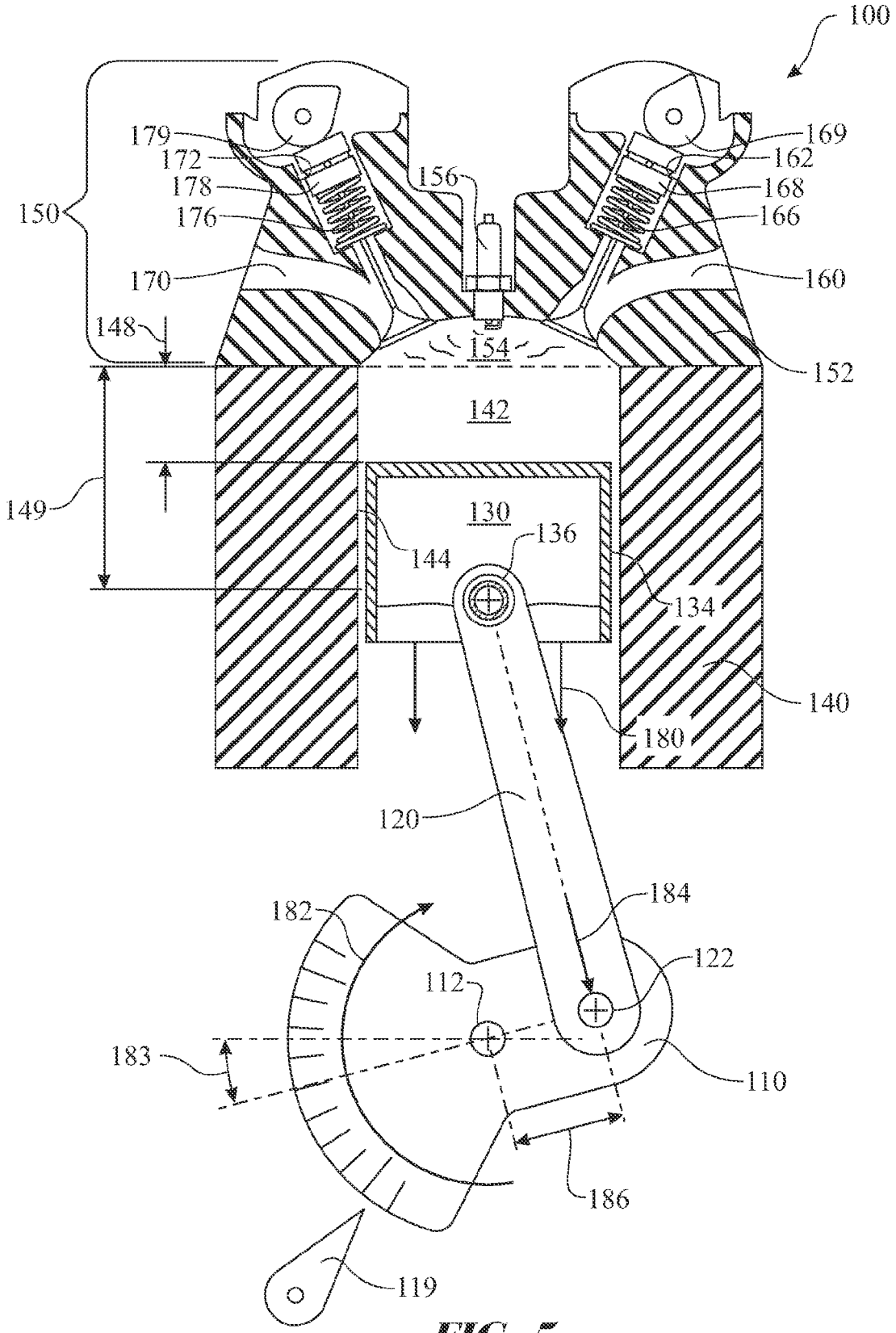
FIG. 5 presents a partially sectioned view of the combustion engine originally introduced in FIG. 1, wherein the engine is illustrated in a rotational position approaching 90° forward of top dead center (TDC) during the power stroke.

Combustion initiates with an intake cycle, where a fuel and air mixture is drawn into the combined cylinder chamber 142 and combustion chamber 154. The intake valve 164 is placed into an open position as the piston 130 is drawn downward. As the piston 130 moves towards bottom dead center (BDC), as illustrated in FIG. 1, the fuel and air flow 153 is drawn through the intake port 160. As the piston 130 reaches bottom dead center (BDC), the intake valve 164 is closed, and the cycle transitions to a compression cycle, where the piston 130 is driven towards the cylinder head assembly 150 or top dead center (TDC) (identified by cylinder chamber top dead center 146) compressing the air and fuel mixture into the combustion chamber 154 as illustrated in FIG. 2. A spark is ignited by an ignition system, represented by a spark plug 156. The spark initiated combustion within the combustion chamber 154 as illustrated in FIG. 3. The combustion creates a pressure (similar to the combustion generated pressure 290 illustrated in a force diagram presented in FIG. 20) that is applied to the piston combustion surface 132 of the piston 130. The force resulting from the pressure generated by the combustion and applied to the piston combustion surface 132 drives the piston 130 downward as illustrated in FIGS. 4 and 5 until the piston 130 reaches the bottom dead center (BDC). As the piston 130 cycles against bottom dead center (BDC), the cylinder head assembly 150 transitions into an exhaust configuration, opening the exhaust valve 174, thus allowing spent fuel and exhaust gasses to be thrust through the exhaust port 170 in a form of an exhaust flow 173. The upward motion of the piston 130 drives the exhaust flow 173 through the exhaust port 170.

In operation, the piston 130 moves in accordance with a piston motion 180. The piston motion 180 oscillates between top dead center 146 and bottom dead center. Combustion within the combustion chamber 154 generates a pressure against the piston combustion surface 132. The distributed load against the piston combustion surface 132 drives the piston 130 downward. The distributed load is apportioned into a linear force that is parallel to a longitudinal axis of the connecting rod 120. The associated motion of and associated forces applied to the piston 130 is transferred to the crankpin 122 of the crankshaft 110 through the connecting rod 120. The linear motion 180 of the piston 130 in combination with the rotational motion 182 of the crankshaft 110 positions the connecting rod 120 at an angular relation to the vertical motion of the piston 130. This angular relation creates an offset referred to as a lever arm distance 186. The generated force 184 in combination with the lever arm distance 186 creates a resulting torque. The resulting torque drive the rotation 182 of the crankshaft 110. The position of the piston is measured by the angular rotation 183 of the crankshaft 110 respective to the timing marker or indicator 119.

Figure 7:
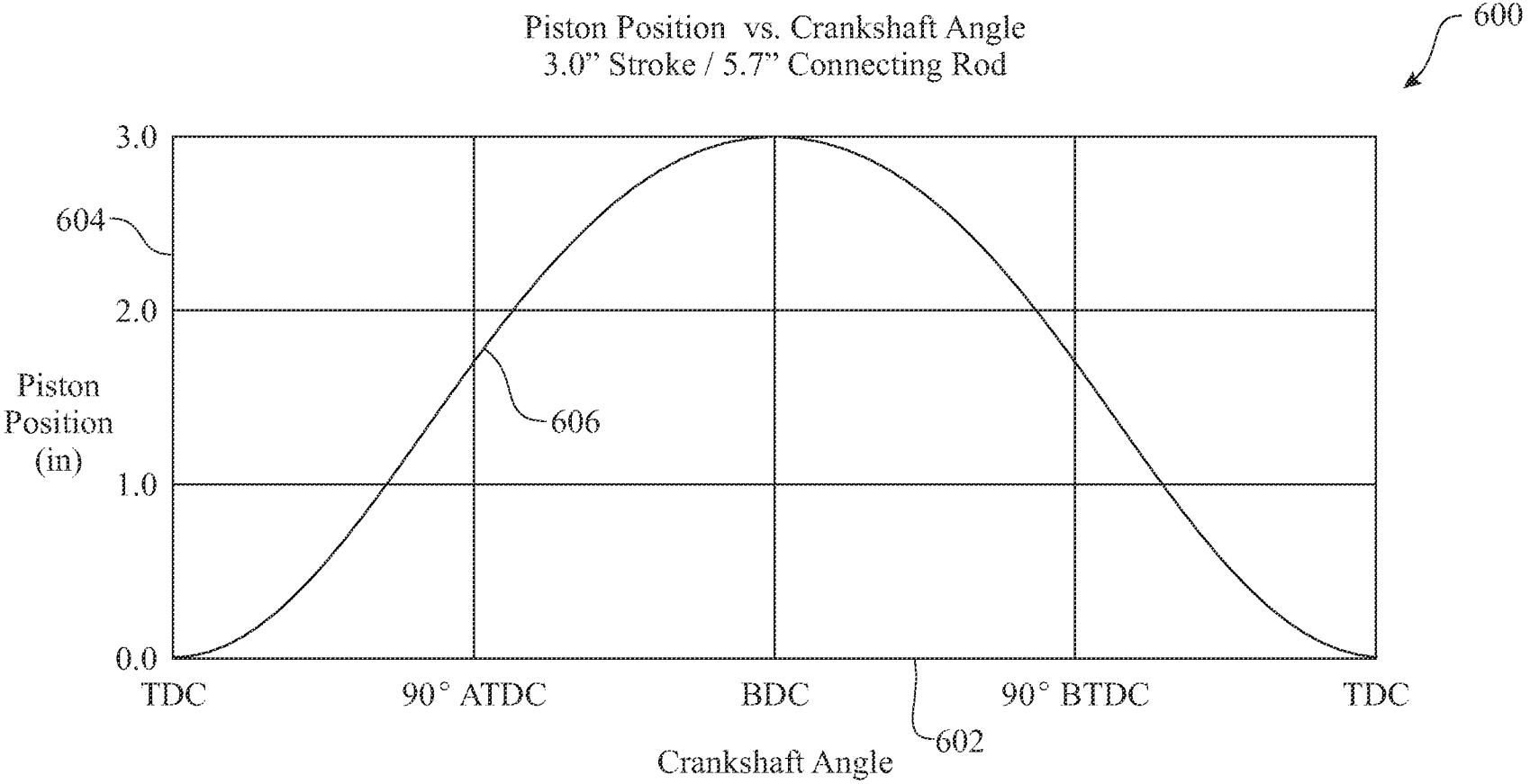
FIG. 7 presents an exemplary engine cycle diagram of the long connecting rod engine configuration illustrating a relationship between a piston position and a crankshaft angle.

A long connecting rod engine component motion chart 600 is illustrated in FIG. 7, wherein the long connecting rod engine component motion chart 600 presents a piston position over engine rotational cycle 606 associated with the long connecting rod combustion engine 100. The piston position over engine rotational cycle 606 plots a displacement from top dead center (TDC) 148, referenced as a distance from top dead center (TDC) (charted along a vertical axis piston position axis 604), during a rotation of the crankshaft 110 (charted along a horizontal axis crankshaft angle axis 602). The curve shape and associated duration of the piston 130 approaching to and departing from top dead center (TDC) are mirror images of one another. Similarly, the curve shape and associated duration of the piston 130 approaching to and departing from bottom dead center (BDC) are also mirror images of one another.

Figure 12:
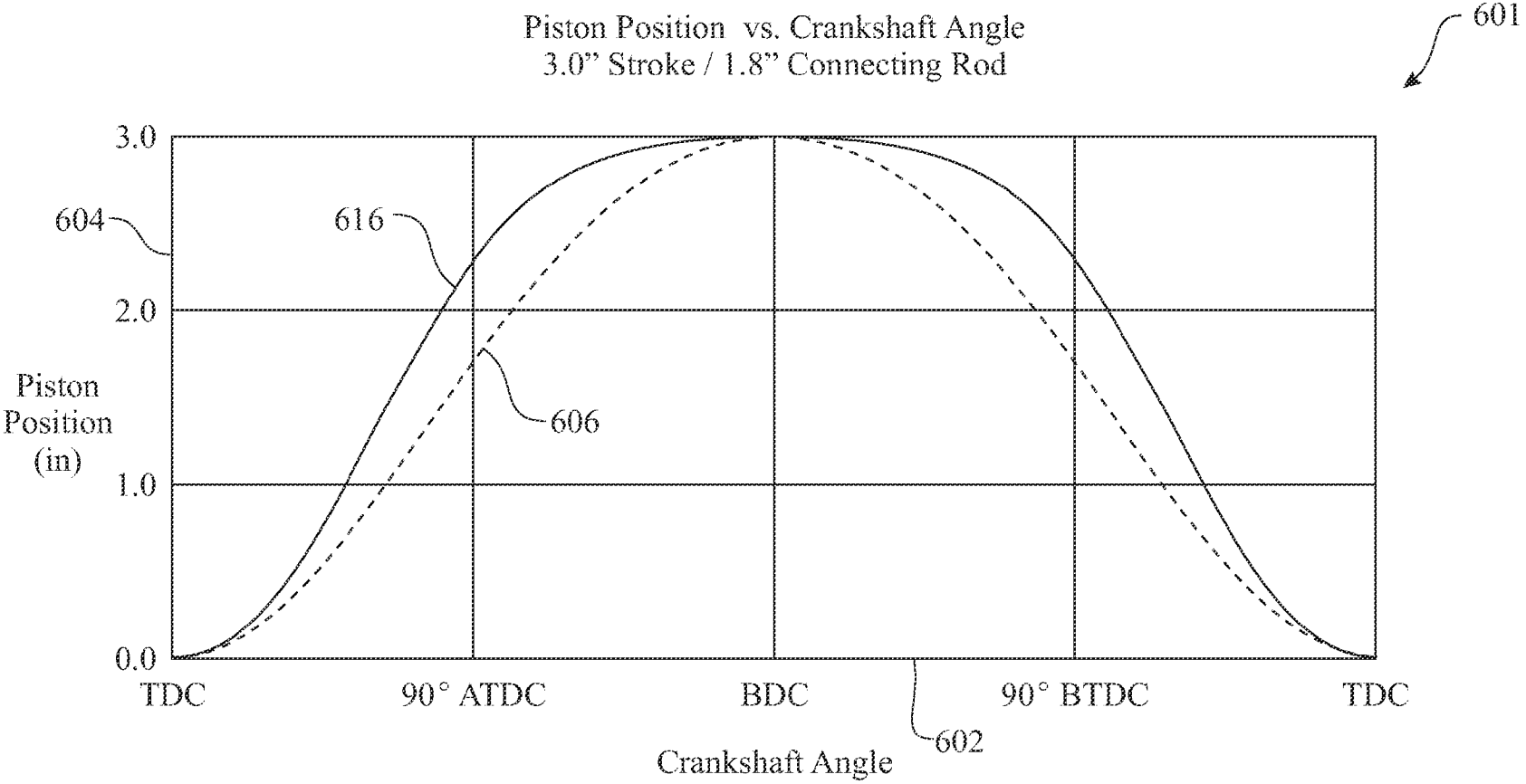
FIG. 12 presents an exemplary engine cycle diagram of the short connecting rod engine configuration illustrating a relationship between a piston position and a crankshaft angle as compared to the similar relationship of the long connecting rod engine.

As shown by the short connecting rod engine component motion chart 601 presented in FIG. 12, the piston position over engine rotational cycle 616 presents a piston position associated with a crankshaft angle for the shorter connecting rod 220 of the associated engine configuration 200. This configuration provides a longer dwell time at bottom dead center (BDC) and a steeper transition curve between bottom dead center (BDC) and top dead center (TDC) compared to the longer connecting rod 120 engine configuration 100.

The short connecting rod engine provides higher lever arm distance 286 during the critical period after top dead center (TDC), but is not without issues. One drawback of the shorter connecting rod is an increase in a piston side loading. Another drawback is a geometric interference between the connecting rod 220, the piston 230, the cylinder chamber sidewall 244 of the cylinder chamber 242, and possibly other elements during the rotational cycling of the engine components.

Figure 8:
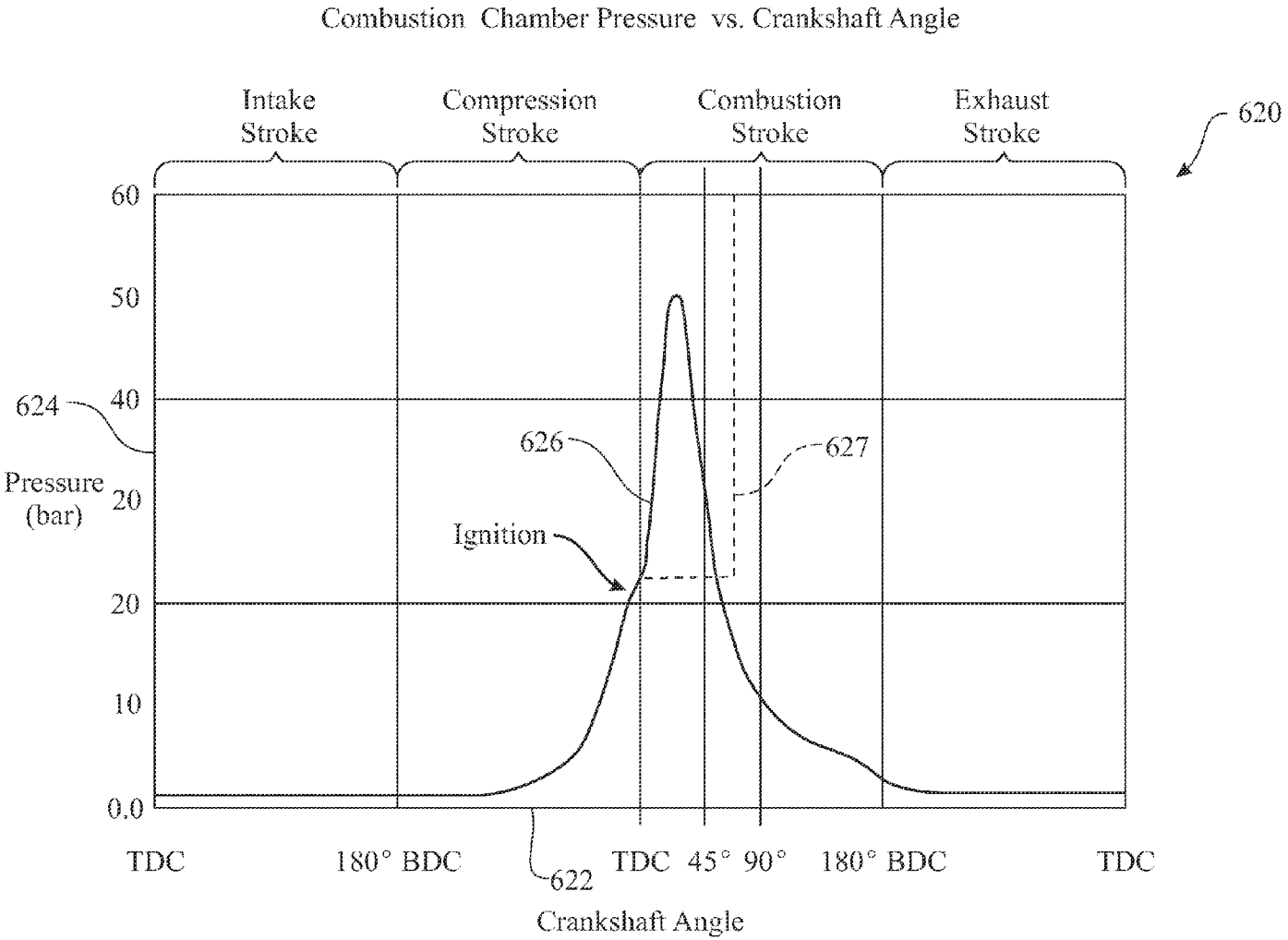
FIG. 8 presents an exemplary pressure diagram of the connecting rod engine configuration illustrating a relationship between combustion chamber pressure and a piston position for each of four engine stroke segments.

The combustion cycle is best illustrated by the exemplary combustion chamber pressure chart 620 presented in FIG. 8. The combustion chamber pressure chart 620 presents an exemplary combustion chamber pressure curve 626 being representative of any crankshaft based combustion engine 100, 200. The combustion chamber pressure curve 626 plots a combustion chamber pressure generated within the cylinder chamber 142, 242 (charted along a vertical axis combustion chamber pressure axis 624), during two complete rotation cycles of the crankshaft 110, 210 (charted along a horizontal axis crankshaft angle axis 622). The chart segments the two complete rotation cycles of the crankshaft 110 into the four (4) stroke segments: an intake stroke, a compression stroke, a combustion stroke, and an exhaust stroke.

Combustion chamber pressure is generated within the combustion chamber 154, 254, wherein the pressure creates the downward distributed force across a surface of the piston combustion surface 132, 232 of the piston 130, 230. Combustion initializes immediately following an ignition event. The ignition event is based upon the rotational angle of the crankshaft 110, 210, which is one of the components considered when discussing timing of the combustion engine 100, 200. As illustrated, ignition commonly occurs just prior to or following when the piston reaches top dead center (TDC). Ignition is commonly initiated by the spark plug 156. Combustion increases in pressure as the gas expands. The pressure decreases as the volume of the cylinder chamber 142, 242 increases, which is a result of the downward motion of the piston 130, 230. The resulting pressure curve 626, as shown, is essentially applied over slightly more than one 45° rotation of the crankshaft 110, 210, or spanning only a narrow portion of the overall two complete rotation cycles of the crankshaft 110, 210. The combustion chamber pressure chart 620 illustrates the narrow span where the combustion is useful for applying a distributed force or loading across the piston combustion surface 132, 232. This can be referred to as an effective pressure segment 627.

Figure 26:
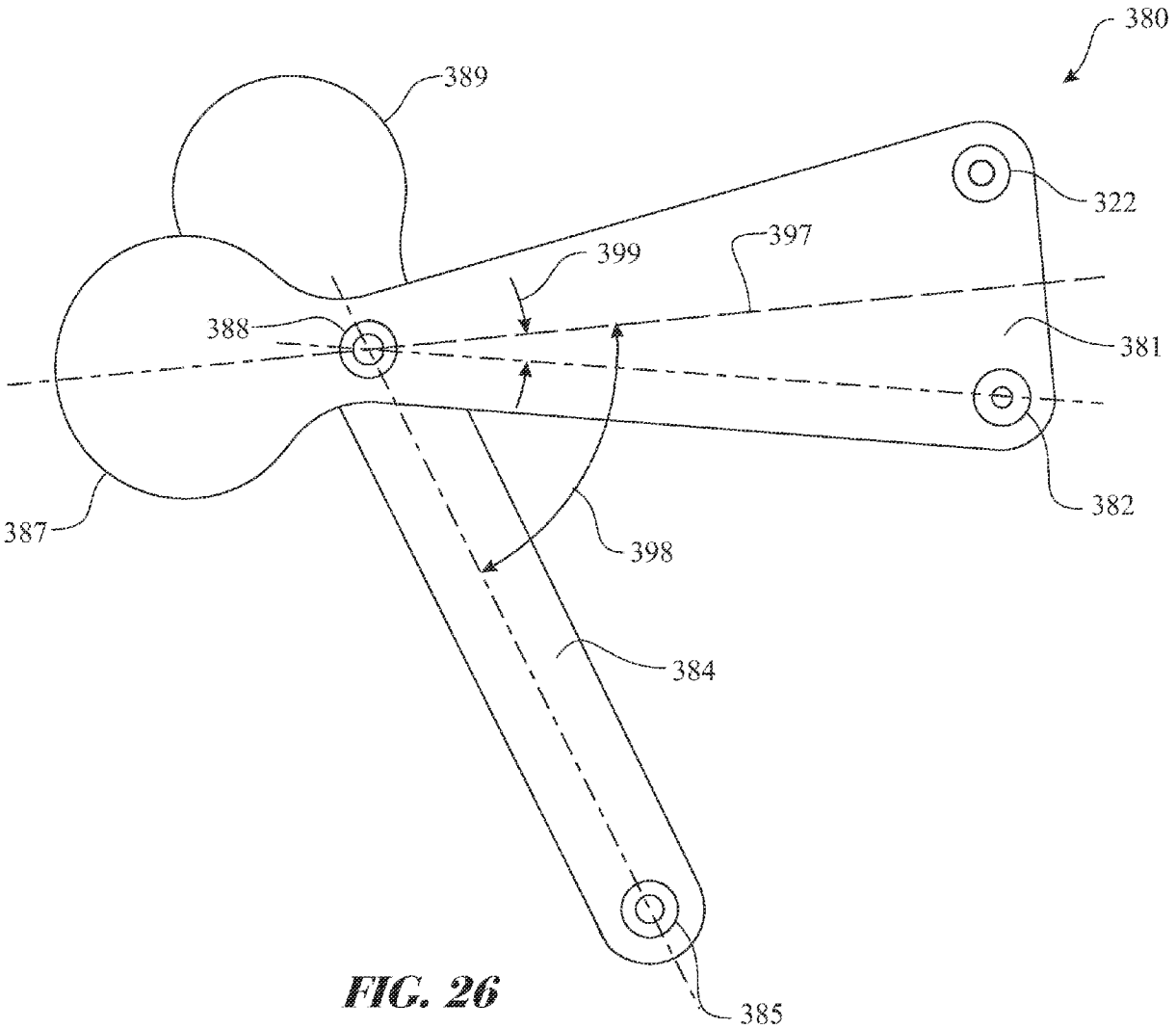
FIG. 26 presents a front view of the piston control rocker arm assembly originally introduced in FIG. 25.
Figure 27:
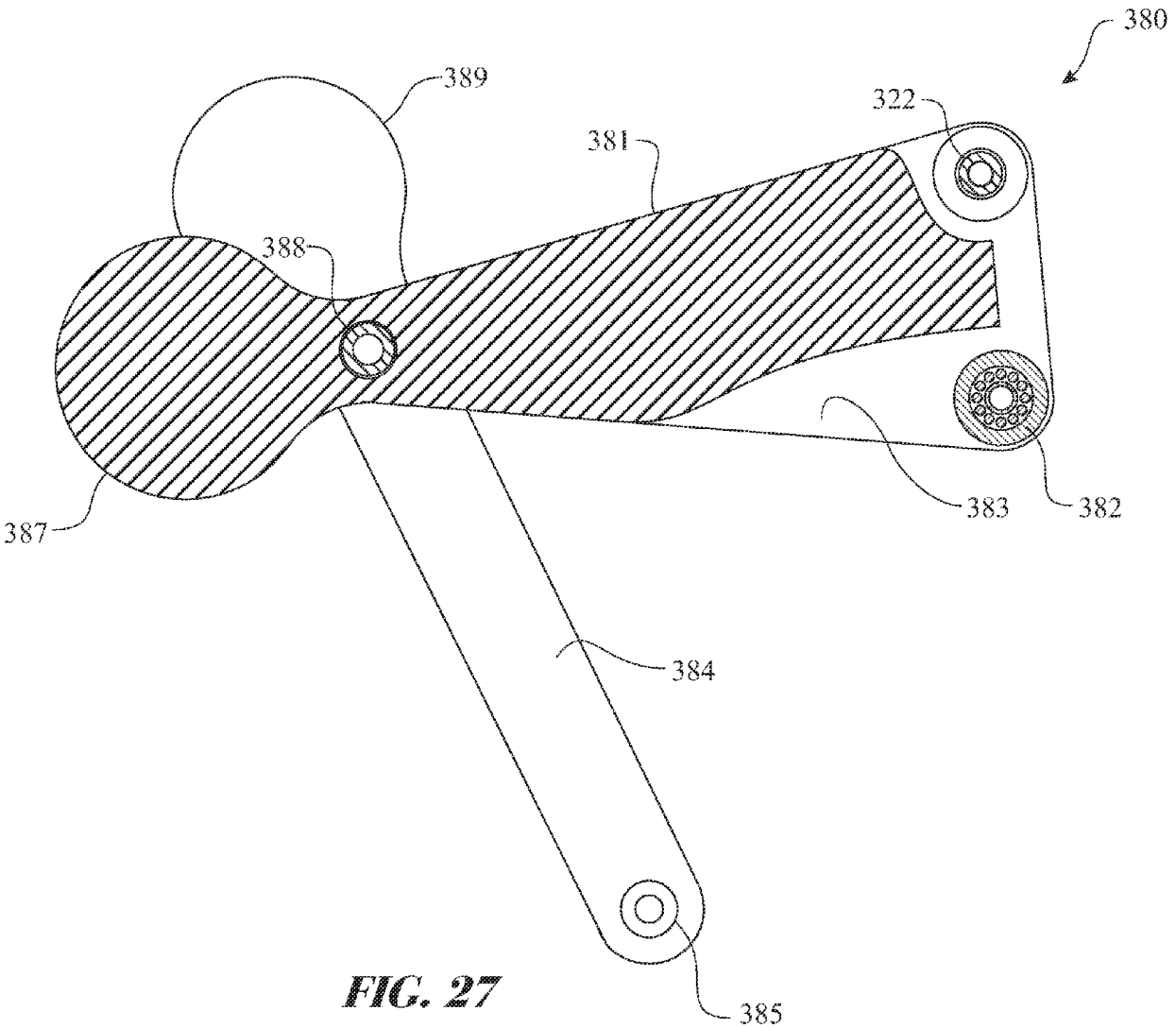
FIG. 27 presents a sectioned front view of the piston control rocker arm assembly originally introduced in FIG. 25, the section being taken along a longitudinal plane of a piston control arm.
Figure 28:
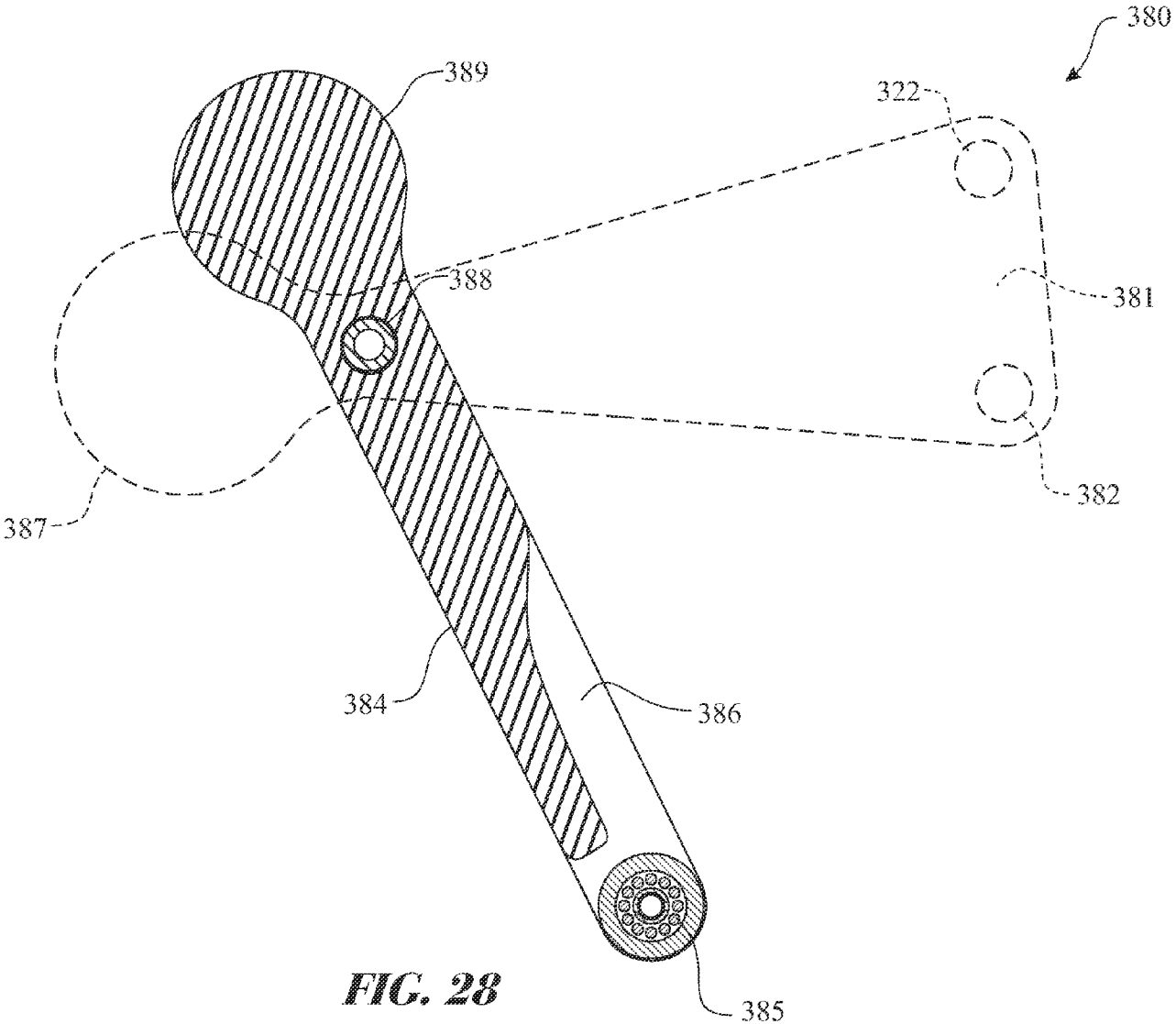
FIG. 28 presents a sectioned front view of the piston control rocker arm assembly originally introduced in FIG. 25, the section being taken along a longitudinal plane of a piston return arm, wherein the piston control arm is shown in phantom for reference.

An exemplary drive cam operated combustion engine 300 is presented in FIGS. 13 through 19, with several of the components being detailed in FIGS. 22 through 28. The drive cam operated combustion engine 300 includes a number of elements, which are similar to elements included in the combustion engine 100, 200. Like features of the drive cam operated combustion engine 300 and the combustion engine 100, 200 are numbered the same except preceded by the numeral "3", with any distinguishing features being described herein. A piston 330, cylinder chamber 342, and cylinder head assembly 350 are essentially the same as the combustion engine 100, 200. The crankcase portion of the engine block 340 is uniquely designed to accommodate the unique bottom end of the drive cam operated combustion engine 300. Initially, the crankshaft 110, 210 is replaced by a central drive cam assembly 310. A piston control rocker arm assembly 380 is employed to provide operational translation between the central drive cam assembly 310 and a piston 330 by way of a connecting rod 320. The piston 330 can be any suitable piston design, including being similar to the piston 130, 230 described above. The connecting rod 320 can be of any suitable connecting rod design, wherein the larger end is adapted for connectivity with a connecting rod and piston control arm connection 322 of the piston control rocker arm assembly 380. Details of the piston control rocker arm assembly 380 are provided in FIGS. 25 through 28. The piston control rocker arm assembly 380 is pivotally assembled to the engine block 340 by the piston control rocker arm assembly pivot member 388. The piston control rocker arm assembly pivot member 388 can be an elongated rod, extending axially through a plurality of piston control rocker arm assemblies 380. The piston control rocker arm assembly pivot member 388 can be supported in a manner similar to a current crankshaft, camshaft and the like. In the exemplary embodiment, the piston control rocker arm assembly pivot member 388 is supported by a piston control rocker arm assembly support member 392, which is secured to the engine block 340 by a piston control rocker arm assembly support member mount 393. The piston control rocker arm assembly 380 can be described as having two primary components, a piston control arm 381 and a piston return arm 384, which are integrated in a manner to have rotational uniformity. The piston control arm 381 and piston return arm 384 can be fabricated as a single forging or as separate members that are subsequently assembled into a single assembly. The exemplary piston control arm 381 includes an operational portion extending in a first direction from the piston control rocker arm assembly pivot member 388 and a piston control arm counterbalance 387 extending in a second, opposite direction from the piston control rocker arm assembly pivot member 388. The exemplary piston return arm 384 includes an operational portion extending in a first direction from the piston control rocker arm assembly pivot member 388 and a piston return arm counterbalance 389 extending in a second, opposite direction from the piston control rocker arm assembly pivot member 388. The piston control arm 381 and piston return arm 384 are arranged having an angular relationship therebetween as illustrated in FIG. 26, wherein the angular relationship is identified as a rocker arm drive arm to return arm angle 398, defined between a bisecting reference line 397 and a central axis of the piston return arm 384. For reference, a rocker arm drive arm offset angle 399 defines the angle between the central axis of the piston control arm 381 and a line between the piston control rocker arm assembly pivot member 388 and the piston control arm cam roller bearing 382. The operational portion of the piston control arm 381 is preferably triangularly shaped, having a span at a distal end thereof. A connecting rod and piston control arm connection 322 is rotationally assembly to an upper, distal end of the operational portion of the piston control arm 381. A piston control arm cam roller bearing 382 is rotationally assembly to a lower, distal end of the operational portion of the piston control arm 381. The piston control rocker arm assembly 380 is pivotally assembled to the engine block 340 by the piston control rocker arm assembly pivot member 388. It is understood that each of the pivot members can be any suitable rotationally supporting elements, including standard bushings or bearings, roller bearings, and the like. The piston control rocker arm assembly 380 can include clearances, such as a piston control arm primary cam clearance 383, best shown in FIG. 27, and a piston control arm secondary cam clearance 386, best shown in FIG. 28. The clearances 383, 386 accounts for any potential interference between the piston control rocker arm assembly 380 and the drive cams 312, 314.

Figure 22:
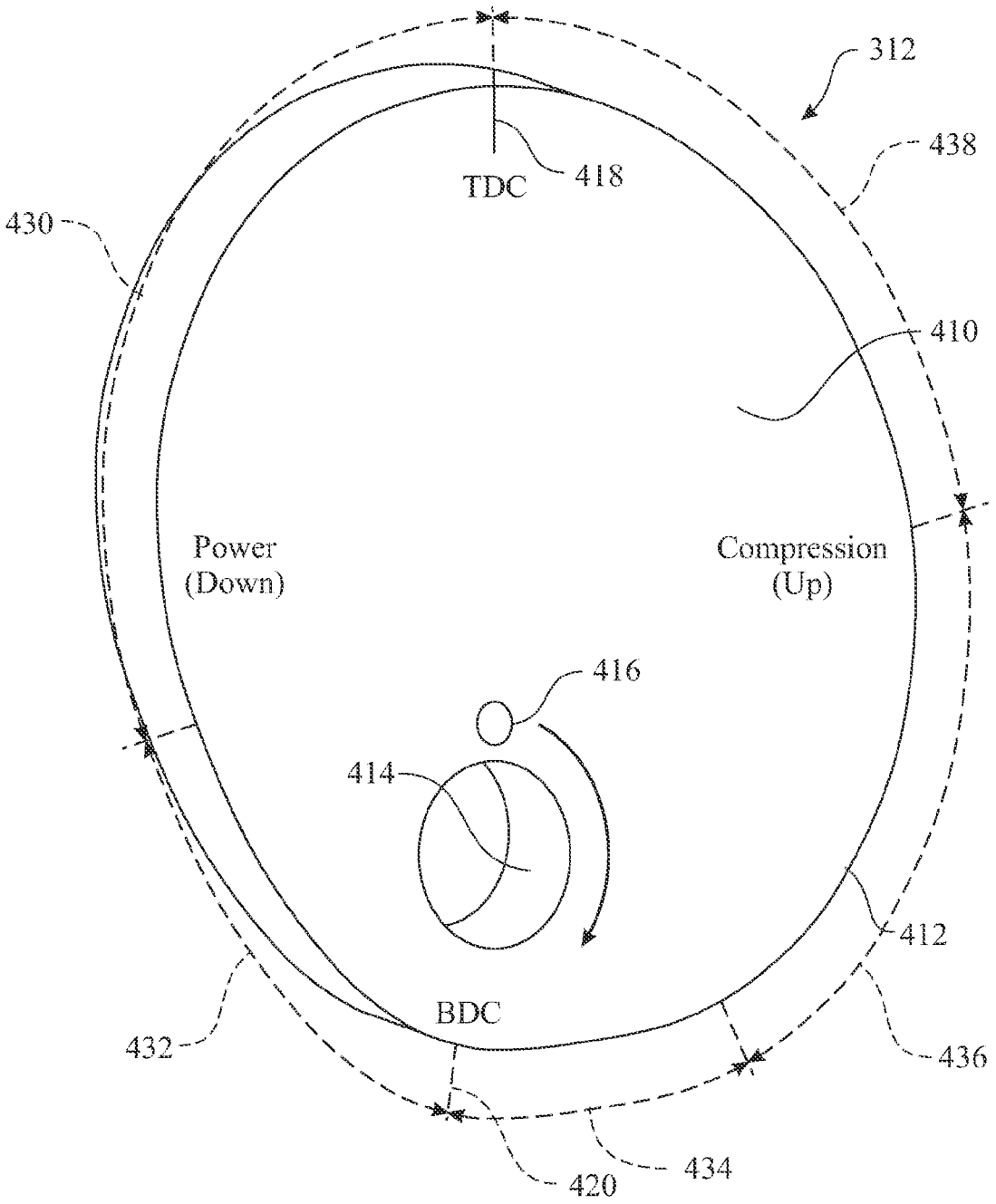
FIG. 22 presents an isometric view of a primary cam body detailing various demarcation points and segments of the engine cycles.
Figure 23:
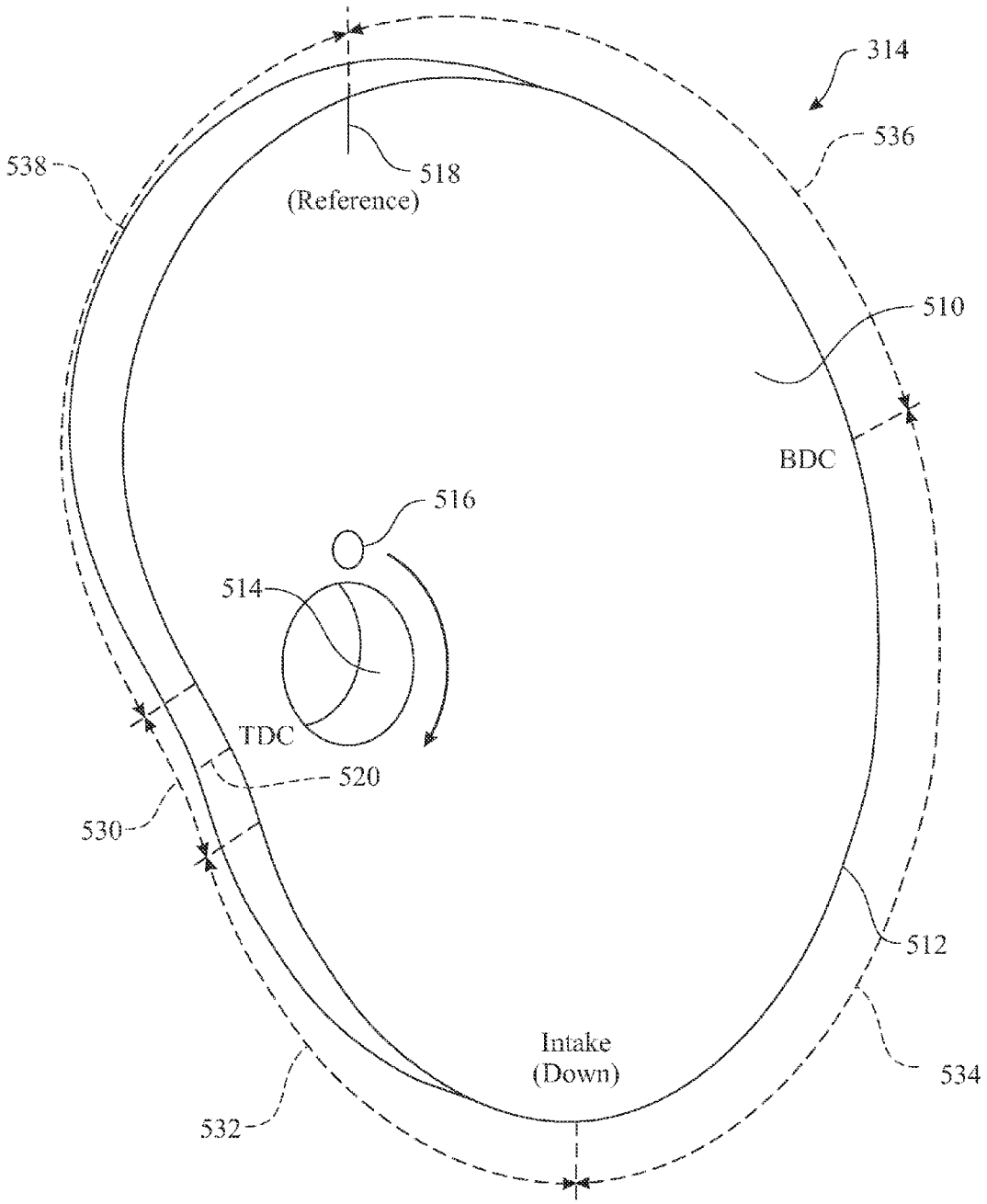
FIG. 23 presents an isometric view of a secondary cam body detailing various demarcation points and segments of the engine cycles.
Figure 24:
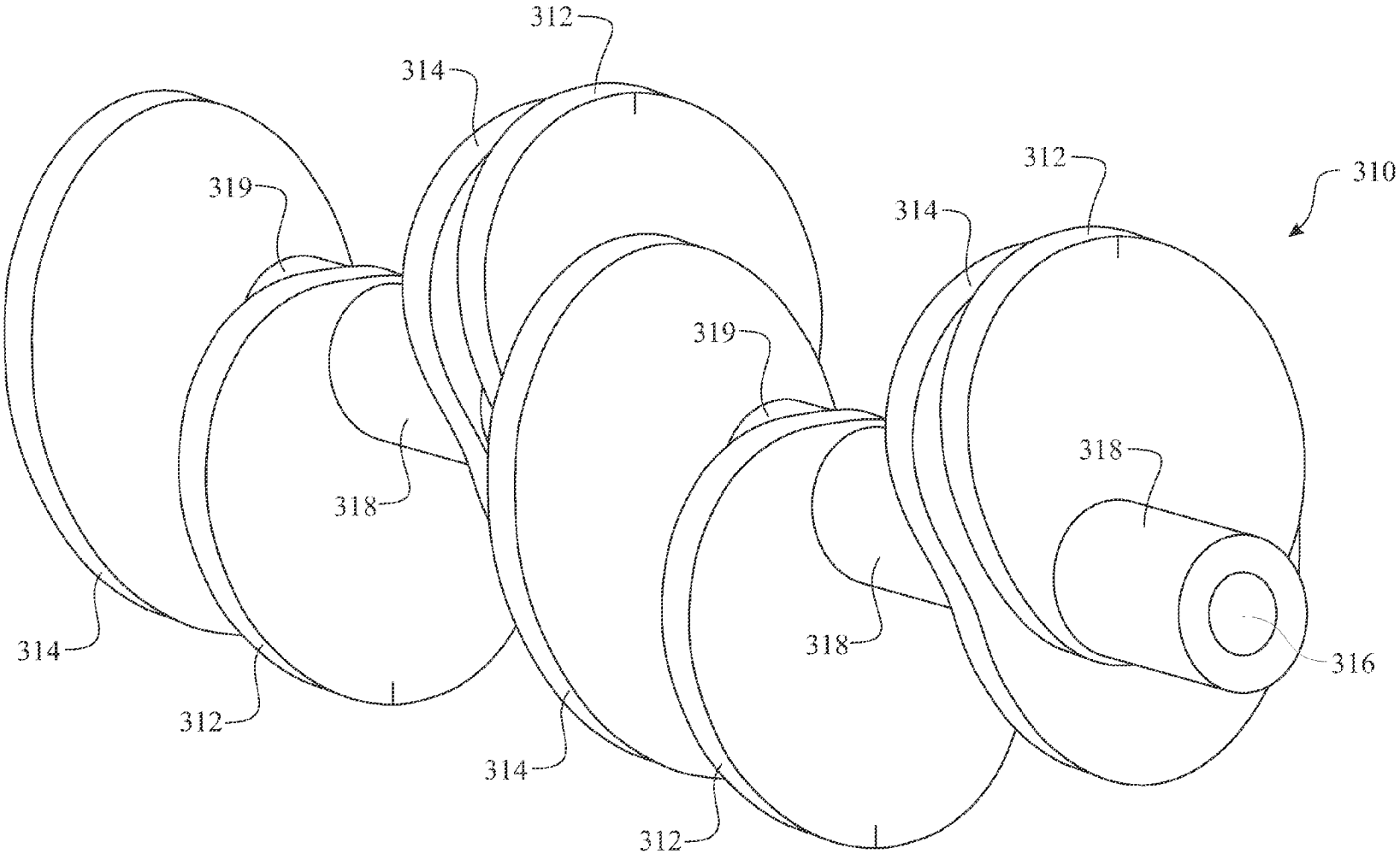
FIG. 24 presents an isometric view of an exemplary central drive cam assembly.
Figure 25:
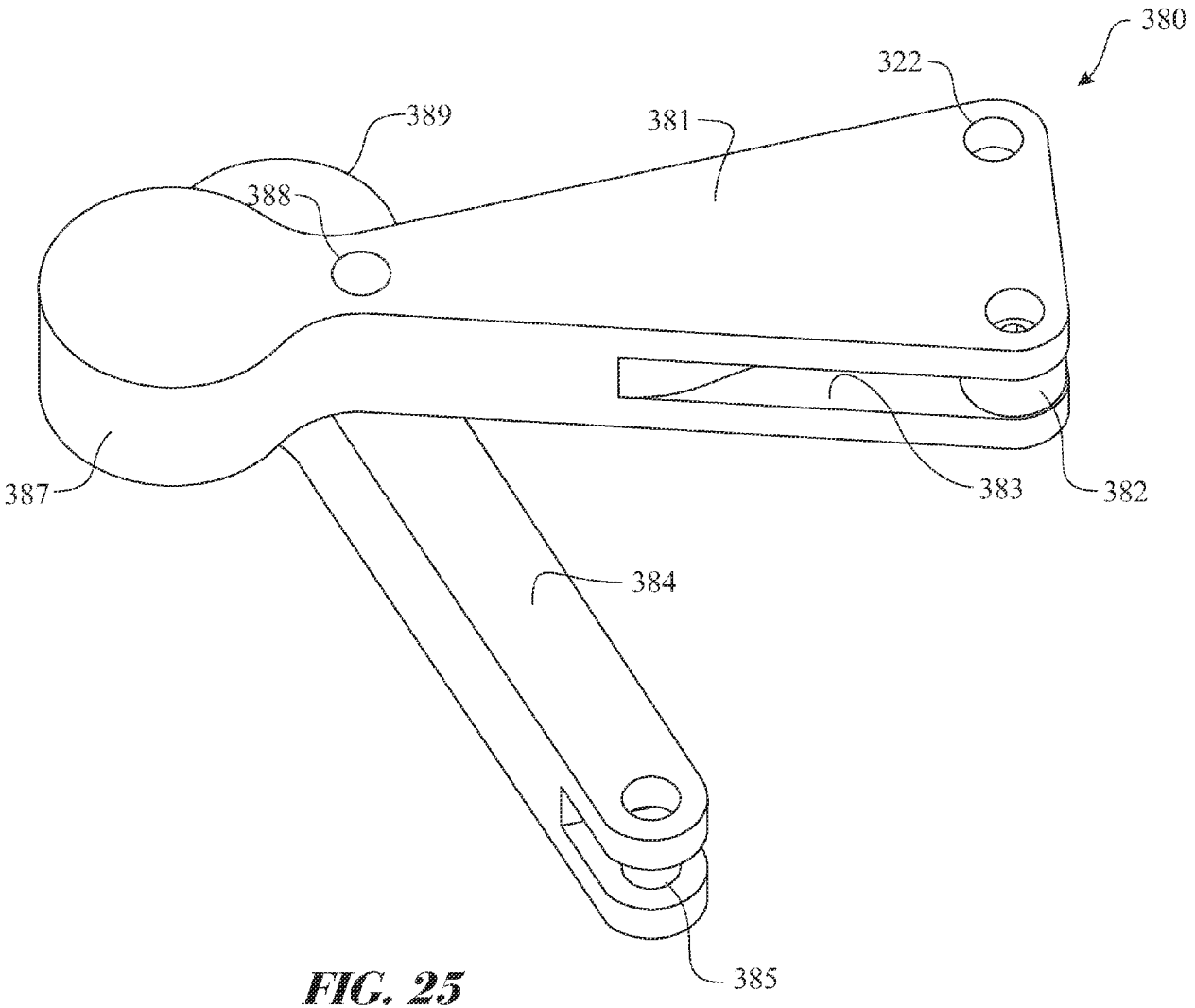
FIG. 25 presents an isometric view of an exemplary piston control rocker arm assembly.

Details of the central drive cam assembly 310 are presented in FIGS. 22 through 24. The exemplary central drive cam assembly 310 includes a plurality of primary drive cams 312 and a plurality of secondary drive cams 314, wherein the number of primary drive cams 312 and the number of secondary drive cams 314 are equal and assembled along the central drive cam assembly 310 in pairs for each cylinder. The primary drive cam 312 is detailed in FIG. 22. Similarly, the secondary drive cam 314 is detailed in FIG. 23. The primary drive cam 312 is fabricated having a primary cam body 410 bound by a primary cam body peripheral edge or surface 412. The primary cam body peripheral edge 412 is shaped to operational communicate with a piston control arm cam roller bearing 382 of the piston control rocker arm assembly 380. The shape of the primary cam body peripheral edge 412 is designed to provide the designed piston position and lever arm distance 486. Top dead center (TDC) is achieved when a piston control arm cam roller bearing 382 of the piston control rocker arm assembly 380 contacts a location about the primary cam body peripheral edge 412 identified by a top dead center reference 418. Similarly, bottom dead center (BDC) is achieved when the piston control arm cam roller bearing 382 of the piston control rocker arm assembly 380 contacts a location about the primary cam body peripheral edge 412 identified by a bottom dead center reference 420. The primary cam body peripheral edge 412 is segmented into exemplary peripheral fragments, including an initial quarter fragment 430 representing a first 90° of rotation, which initiates downward control of the piston 330 from top dead center (TDC) towards bottom dead center (BDC), used for an initial portion of both a power stroke or an intake stroke. The primary cam body peripheral edge 412 continues, transitioning from the initial quarter fragment 430 into a second quarter fragment 432, which continues downward control of the piston 330 towards bottom dead center (BDC). The process transitions through bottom dead center (BDC) as the piston control arm cam roller bearing 382 passes along the 434. The cycle changes direction converting to an upstroke while the piston control arm cam roller bearing 382 rides along the third quarter fragment 436 and the final quarter fragment 438. The region of the primary cam body peripheral edge 412 transitioning between the final quarter fragment 438 and the initial quarter fragment 430 can be designed and shaped to maintain the piston 330 at top dead center (TDC) over a prolonged period of time. The configuration of the drive cam operated combustion engine 300 generating a dwell time at top dead center (TDC) enables expansion at constant volume, thus approaching an ideal execution of an Otto cycle. The utilization of the central drive cam assembly 310 provides a design capable of introducing a dwell time to the motion of the piston 330 while the piston 330 is located in at least one of top dead center (TDC) and bottom dead center (BDC). This is distinct from a crankshaft driven engine 100, 200, wherein the crankshaft driven engine 100, 200 is limited to a circular motion of the crankpin 122, 222, resulting in an instantaneous placement at each of top dead center (TDC) and bottom dead center (BDC).

A second unique distinction of the drive cam operated combustion engine 300 is the ability to design each of the primary drive cam 312 and secondary drive cam 314 to control a timing of the sliding motion of the piston 330. The primary cam body peripheral edge 412 and the secondary cam body peripheral edge 512 can be shaped to generate symmetric or asymmetric motion of the piston 330. The primary cam body peripheral edge 412 and secondary cam body peripheral edge 512 can be shaped in accordance with a design that controls the upward or downward motion of the piston 330 during a rotational motion of the central drive cam assembly 310 that is greater than 180° and the respective downward or upward motion of the piston 330 during a rotational motion of the central drive cam assembly 310 that is less than 180°. This is distinct from a crankshaft driven engine 100, 200, wherein the crankshaft driven engine 100, 200 is limited to a circular motion of the crankpin 122, 222, thus only capable of controlling the upward motion of the piston 330 during a rotational motion of the crankshaft 110, 210 over one 180° portion thereof and controlling the downward motion of the piston 330 during a rotational motion of the crankshaft 110, 210 over a remaining 180° portion thereof.

Figure 15:
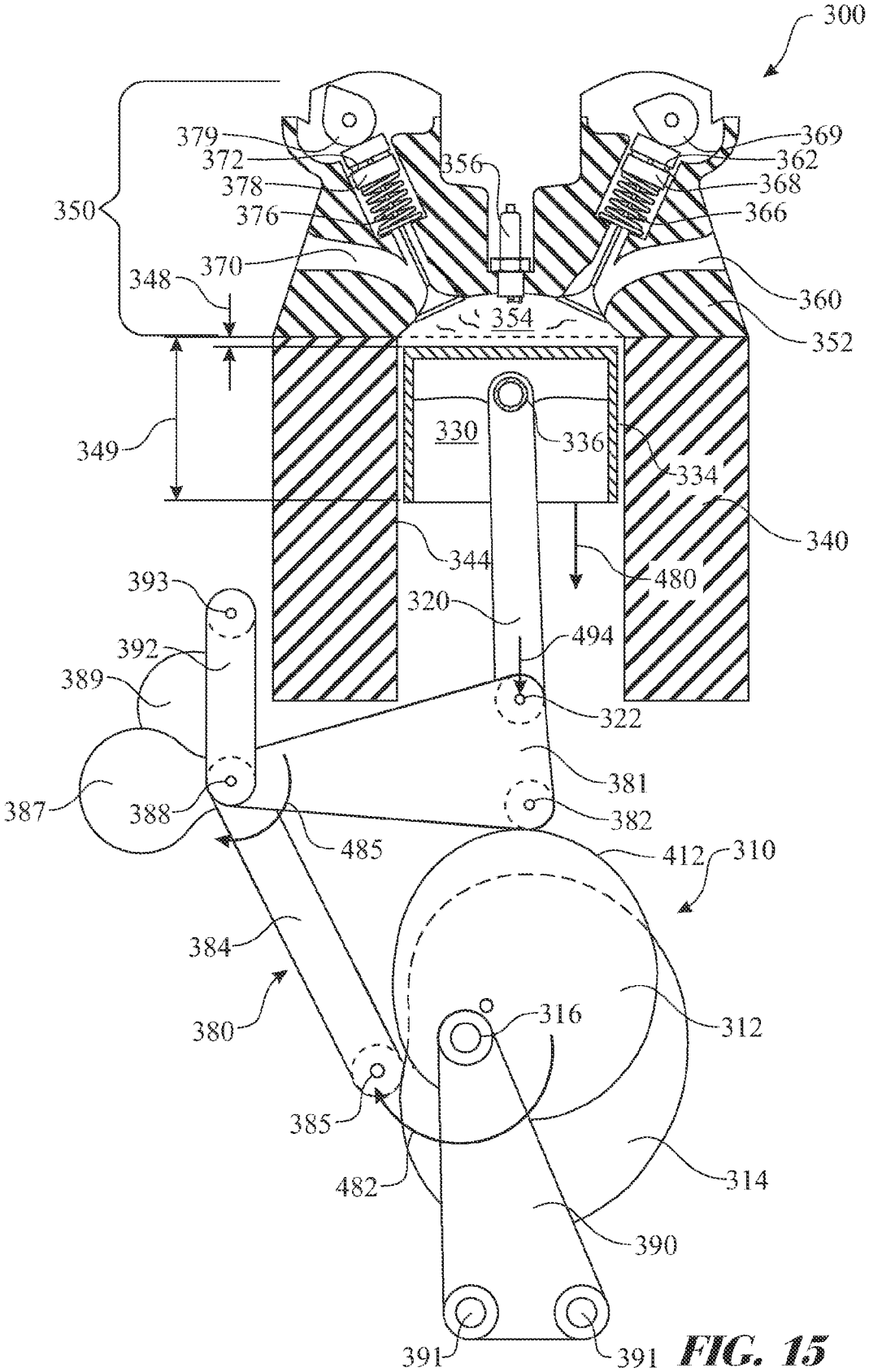
FIG. 15 presents a partially sectioned view of the drive cam operated combustion engine originally introduced in FIG. 13, wherein the engine is illustrated in a rotational position slightly forward of top dead center (TDC) at initialization of the power stroke.
Figure 16:
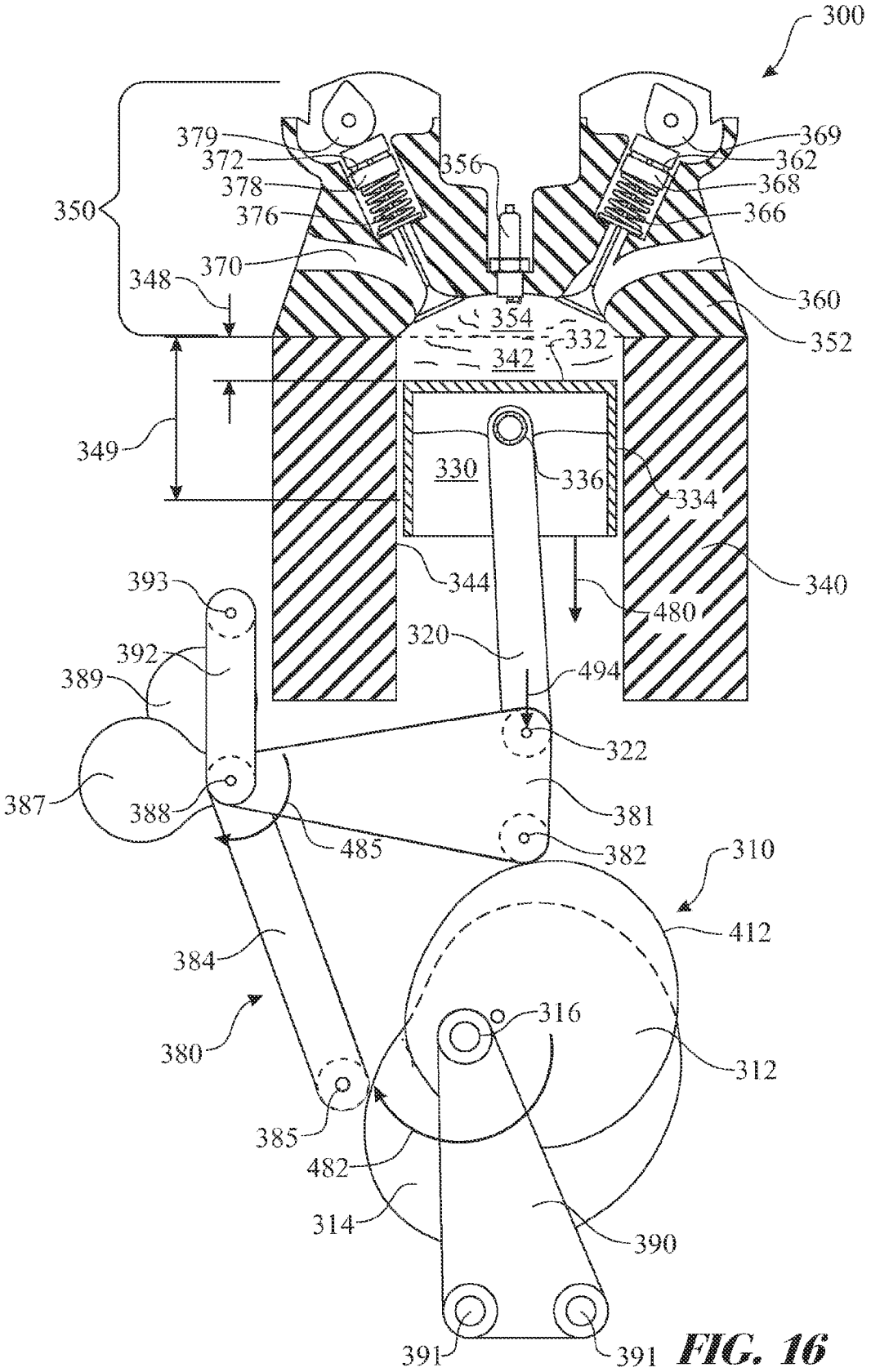
FIG. 16 presents a partially sectioned view of the drive cam operated combustion engine originally introduced in FIG. 13, wherein the engine is illustrated in a rotational position forward of top dead center (TDC) during the power stroke.
Figure 17:
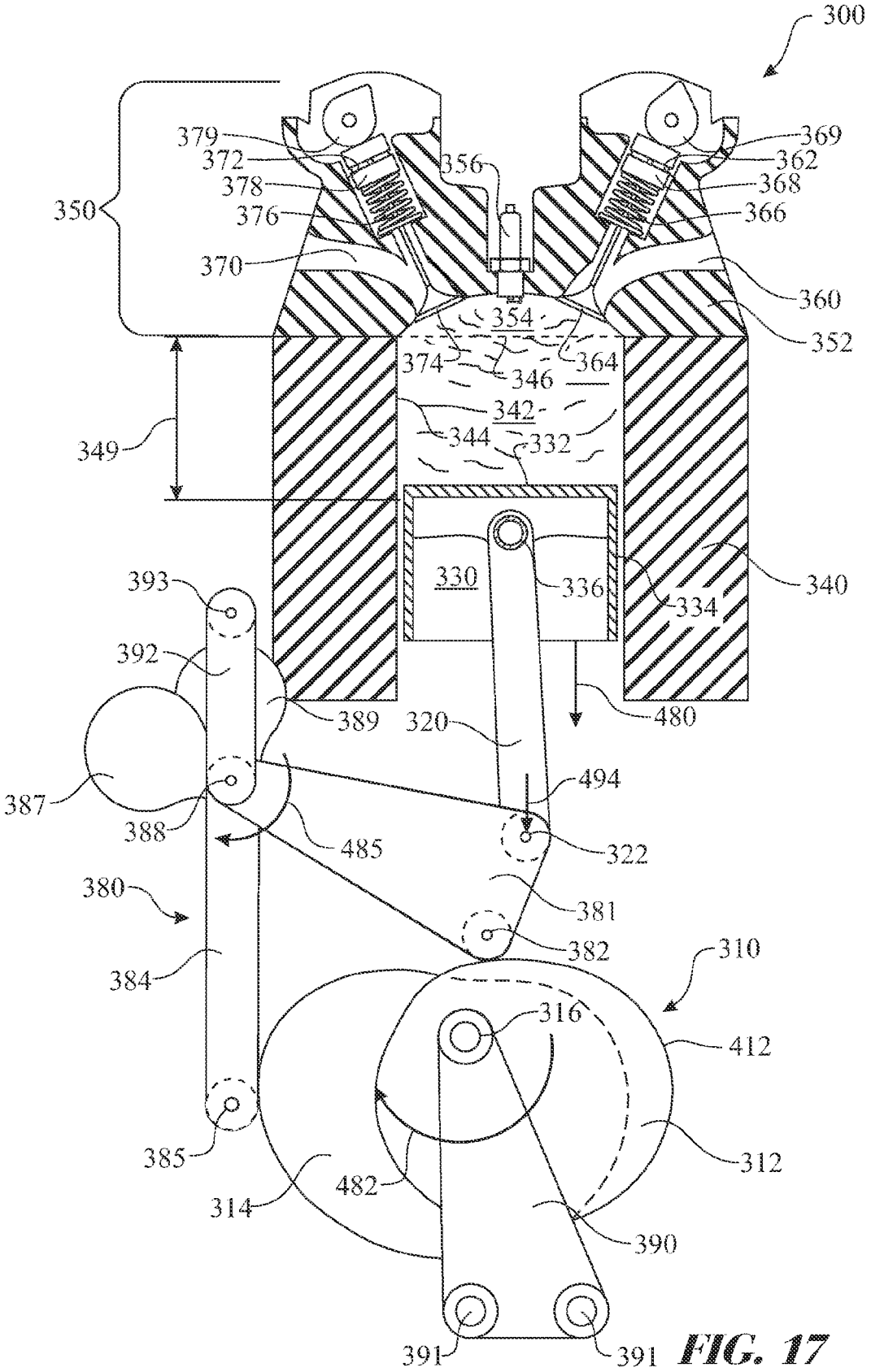
FIG. 17 presents a partially sectioned view of the drive cam operated combustion engine originally introduced in FIG. 13, wherein the engine is illustrated in a rotational position approaching a bottom dead center (BDC) nearing an end of the power stroke.
Figure 18:
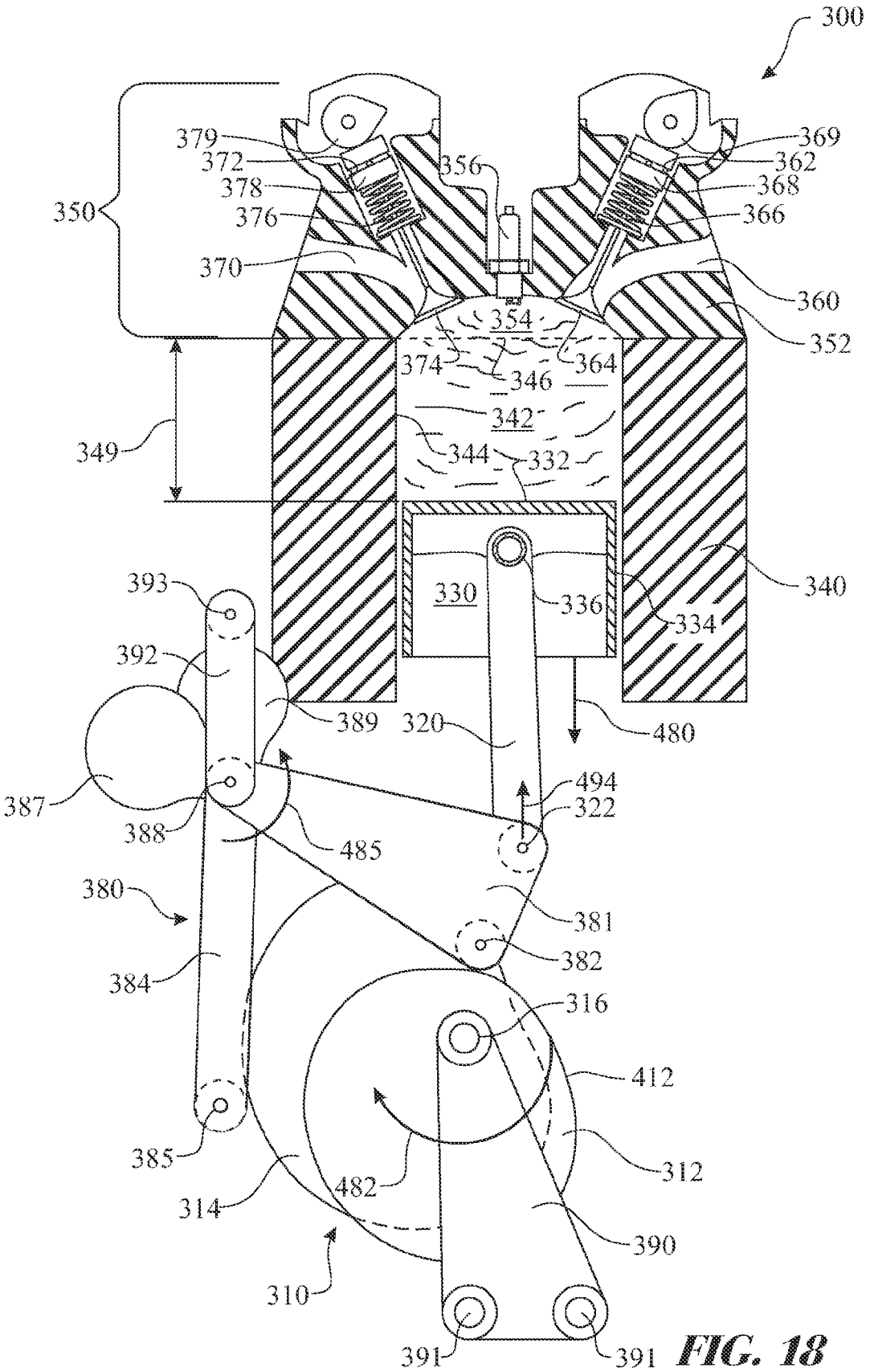
FIG. 18 presents a partially sectioned view of the drive cam operated combustion engine originally introduced in FIG. 13, wherein the engine is illustrated in a rotational position at the bottom dead center (BDC) transitioning from the power stroke to an exhaust stroke.
Figure 19:
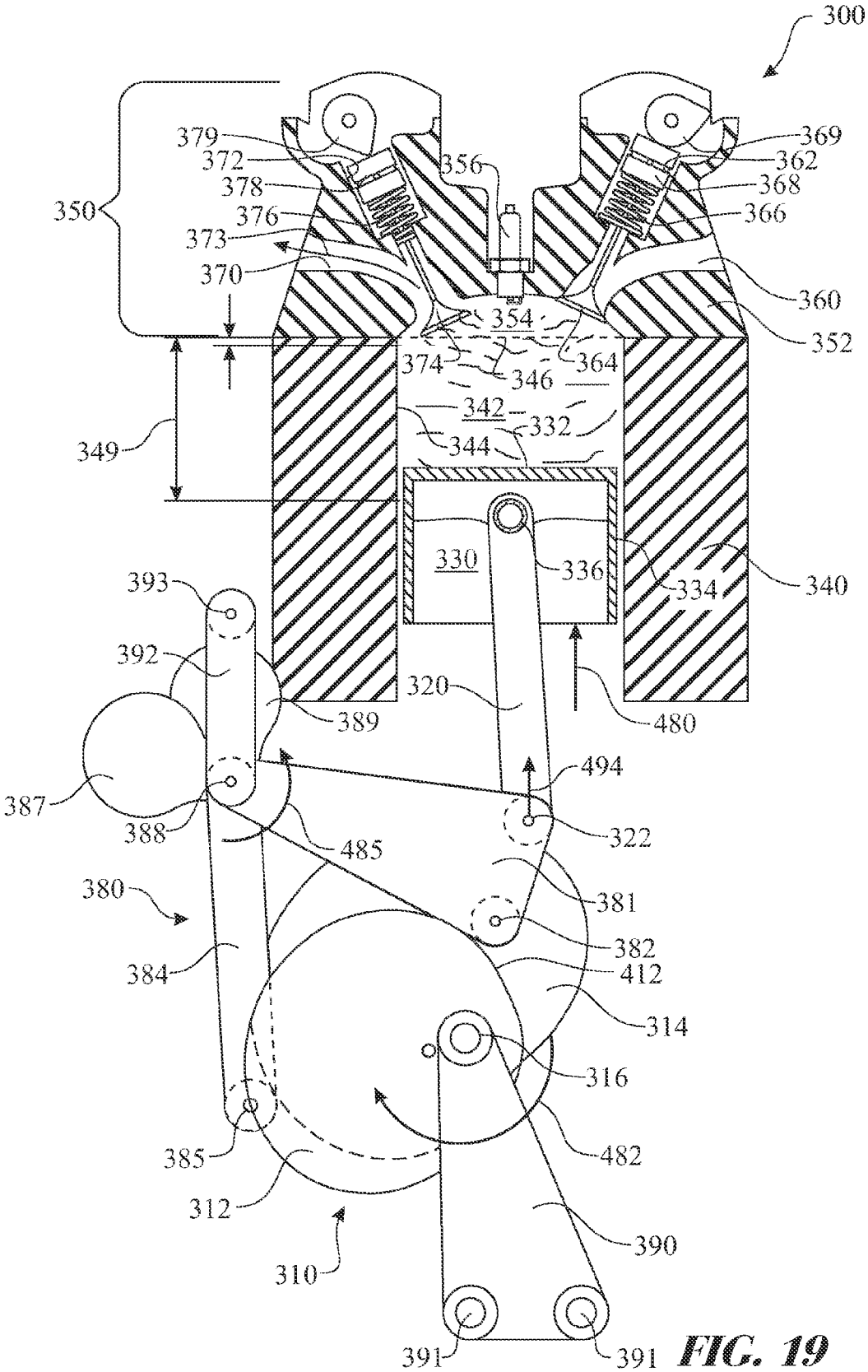
FIG. 19 presents a partially sectioned view of the drive cam operated combustion engine originally introduced in FIG. 13, wherein the engine is illustrated in a rotational position forward of bottom dead center (BDC) during the exhaust stroke.

Details of the secondary drive cam 314 are illustrated in FIG. 23. The secondary drive cam 314 is fabricated having a secondary cam body 510 bound by a secondary cam body peripheral edge or surface 512. The secondary cam body peripheral edge 512 is shaped to operational communicate with a piston return arm cam roller bearing 385 of the piston control rocker arm assembly 380. The kidney shape of the secondary cam body peripheral edge 512 is designed to provide the designed piston position and retain the piston control arm cam roller bearing 382 in contact with the primary cam body peripheral edge 412, particularly as the piston 330 approaches and reaches top dead center (TDC). The position of the piston 330 at top dead center (TDC) is retained when the piston return arm cam roller bearing 385 contacts a location about the secondary cam body peripheral edge 512 identified by a top dead center contact point 520. A top dead center reference 518 can be provided upon a surface of the secondary cam body 510, wherein the top dead center reference 518 would be located angularly with the top dead center reference 418 of the primary cam body 410 to aid in registering the rotational positioning of the primary drive cam 312 and the secondary drive cam 314 with one another. The secondary cam body peripheral edge 512 is segmented into exemplary peripheral fragments, including a top dead center retention fragment 530 representing an initial retention fragment for retaining the piston 330 at top dead center (TDC). A first quarter fragment 532 represents a contact surface area engaging with the piston return arm cam roller bearing 385 during an initial 90° of rotation, which initiates downward control of the piston 330 from top dead center (TDC) towards bottom dead center (BDC), used for an initial portion of the intake stroke as illustrated in FIG. 15. The secondary cam body peripheral edge 512 continues, transitioning from the first quarter fragment 532 into a second quarter duration 534, which continues downward control of the piston 330 towards bottom dead center (BDC) as illustrated in FIG. 16. The secondary cam body peripheral edge 512 continues, transitioning from the second quarter duration 534 into a third quarter fragment 536, as the piston 330 passes bottom dead center (BDC) as illustrated in FIG. 17, changes direction, and begins to return towards top dead center (TDC). The secondary cam body peripheral edge 512 continues, transitioning from the third quarter fragment 536 into a final quarter fragment 538, as the piston 330 returns towards and approaches top dead center (TDC) as illustrated in FIG. 19. As the piston 330 approaches top dead center (TDC), the piston return arm cam roller bearing 385 returns to the top dead center retention fragment 530, wherein the inward shape of the top dead center retention fragment 530 restrains the components of the system from any unwanted bouncing motion.

The central drive cam assembly 310 includes a series of linearly arranged extended drive cam spacers 318 and short drive cam spacers 319. The extended drive cam spacers 318 are located between sets of drive cams 312, 314. A short drive cam spacer 319 is located between each adjacent primary drive cam 312 and secondary drive cam 314. At least a portion of the series of extended drive cam spacers 318 is supported by a central drive cam assembly support member 390. The central drive cam assembly support member 390 can be provided in any suitable design, such as being integrated into the crankcase of the engine block 340, provided as a separate mounting bracket (as illustrated), and the like. The exemplary central drive cam assembly support member 390 is mechanically attached to a support element by a series of central drive cam assembly support member mounts 391. Each of the primary drive cams 312 and secondary drive cams 314 are assembled to the extended drive cam spacers 318 and short drive cam spacers 319 in a manner to retain an angular relation to one another. The central drive cam assembly 310 can be fabricated by machining a single billet of material or joining individual components. In the exemplary embodiment, the extended drive cam spacers 318 and short drive cam spacers 319 can be a single continuous shaft, where the primary cam body 410 of the primary drive cam 312 is slideably assembled upon the shaft by inserting the shaft through a primary cam support aperture 414. Similarly, the secondary cam body 510 is slideably assembled upon the shaft by inserting the shaft through a secondary cam support aperture 514. The primary cam bodies 410 and secondary cam bodies 510 are rotationally fixed using any suitable joining process, including welding, and the like. In the exemplary embodiment, the various components are retained in rotational unison by integrating a series of cam torsional control pins 416, 516 therewith, wherein the torsional control pins 416, 516 are distally located from a central rotational axis.

Counterbalancing can be accomplished using any of a variety implementations. In one exemplary embodiment, counterbalancing of the central drive cam assembly 310 can be accomplished by arranging the primary drive cam 312 and secondary drive cam 314 in opposite sets. In an alternative, the central drive cam assembly 310 can include counterweights to provide both static and dynamic balancing, such as the counterweight configurations employed by currently known crankshafts. Each set of drive cams 312, 314 are arranged in accordance with an ignition timing of each associated piston 330. Counterbalancing can be provided for each drive cam 312, 314 individually, in accordance with each set of drive cams 312, 314 or in accordance with a plurality of sets of drive cams 312, 314.

Although the piston control rocker arm assembly 380 is shown having an independent piston control arm counterbalance 387 and an independent piston return arm counterbalance 389, it is understood that the piston control arm counterbalance 387 and piston return arm counterbalance 389 can be combined and positionally arranged into a single counterbalancing element.

Figure 14:
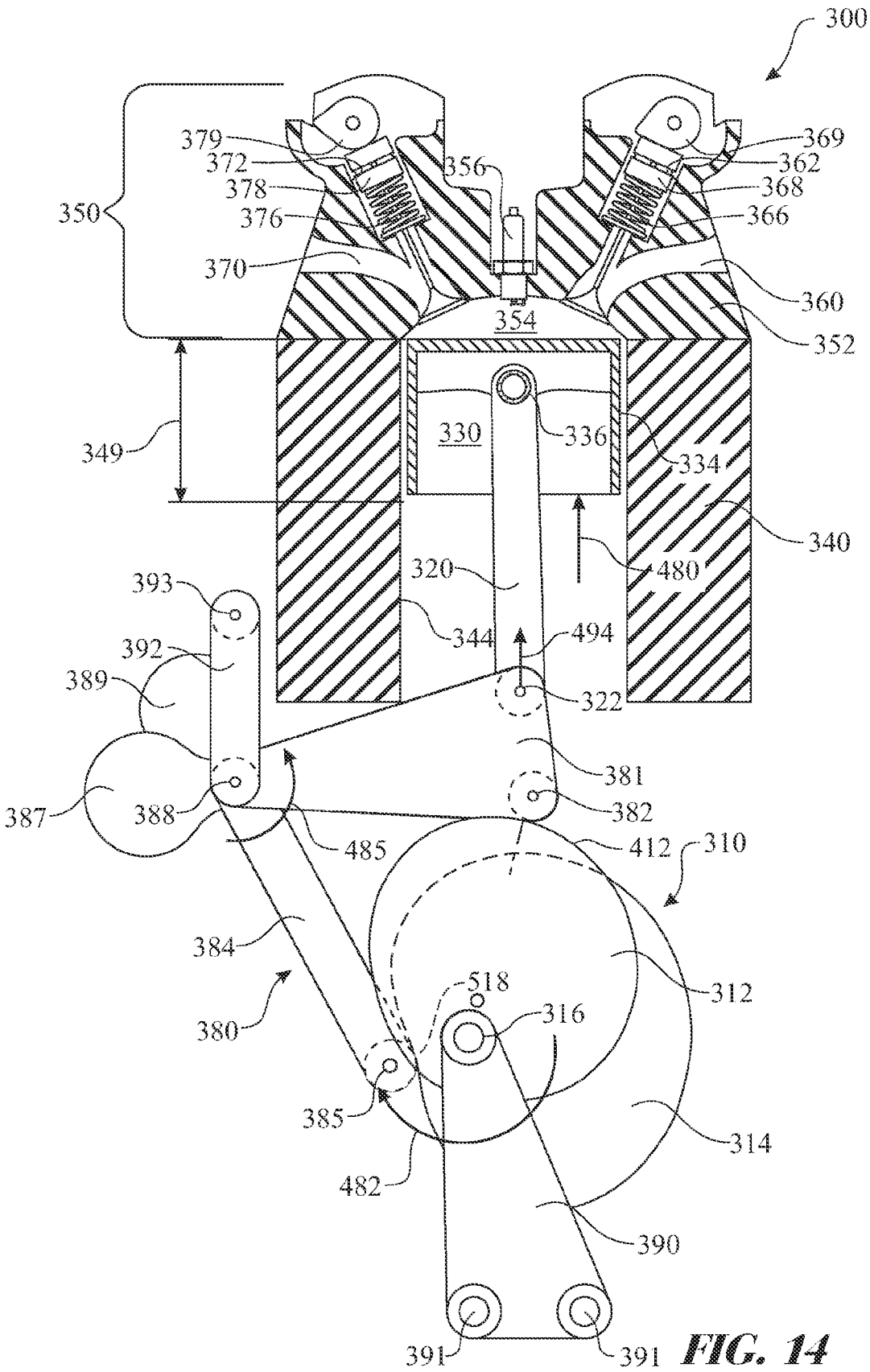
FIG. 14 presents a partially sectioned view of the drive cam operated combustion engine originally introduced in FIG. 13, wherein the engine is illustrated in a top dead center (TDC) rotational position.
Figure 21:
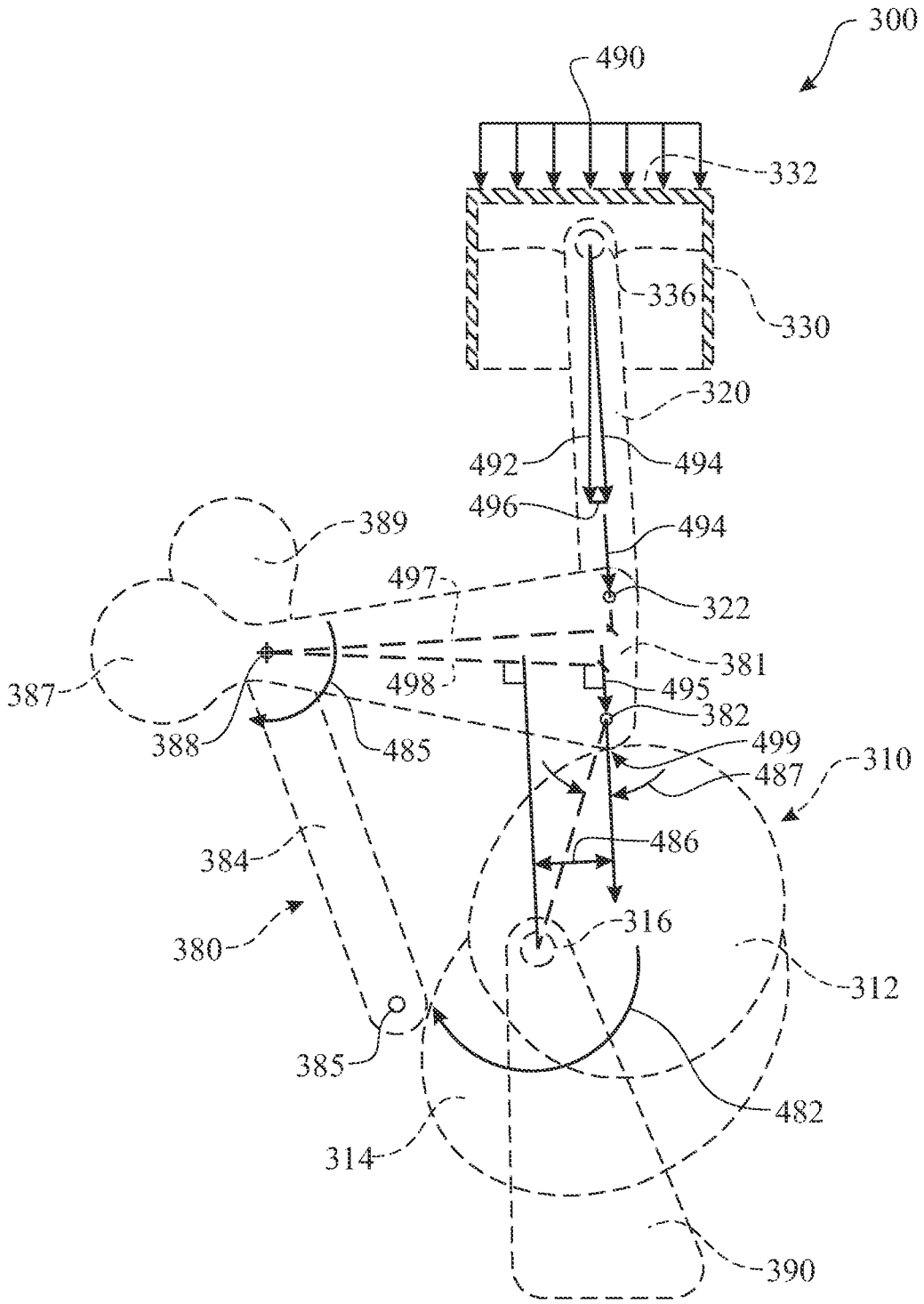
FIG. 21 presents an exemplary force diagram overlaid upon a drive cam operated combustion engine.

During operation, an initial downward motion of the piston 330 (identified by a piston motion 480 in FIG. 13) occurs during an intake stroke. An intake valve 364 of the cylinder head assembly 350 is placed into an open position, allowing a fuel and air flow 353 to flow through an intake port 360 and enter a combustion chamber 354 formed within the cylinder head assembly 350. The downward motion of the piston 330 results from the first quarter fragment 532 and second quarter duration 534 of the secondary cam body peripheral edge 512 applying an outwardly directed force to the piston return arm cam roller bearing 385. The outwardly directed force pivots the piston control rocker arm assembly 380 in a first rotational direction about the piston control rocker arm assembly pivot member 388, wherein the rotation is identified as a rocker arm assembly pivotal motion 485. The pivotal motion of the piston control rocker arm assembly 380 draws the distal end of the piston control arm 381 away from the cylinder chamber 342. The piston 330 is operationally connected to the piston control arm 381 by the connecting rod 320. The movement of the piston control arm 381 draws the piston 330 downward, increasing a volume defined by the cylinder chamber 342. The motion additionally introduces a vacuum, which draws the fuel and air flow 353 through the intake port 360 and into a volume defined by a combination of the combustion chamber 354 and cylinder chamber 342. The rotation of the central drive cam assembly 310 continues with the piston 330 approaching bottom dead center (BDC). As the piston 330 transitions from an intake stroke to a compression stroke, the intake valve cam lobe 369 rotates, closing the intake valve 364, forming a gas tight volume defined by the combination of the combustion chamber 354 and cylinder chamber 342. The bottom dead center transition 434 initiates the compression stroke. The piston control arm cam roller bearing 382 rides along the bottom dead center transition 434 and continues riding along the third quarter fragment 436 of the primary cam body peripheral edge 412 causing the piston control rocker arm assembly 380 to pivot in a second, opposite rotational direction about the piston control rocker arm assembly pivot member 388. The pivotal motion of the piston control rocker arm assembly 380 drives the distal end of the piston control arm 381 towards the cylinder chamber 342. The piston control arm cam roller bearing 382 continues riding along the final quarter fragment 438 of the primary cam body peripheral edge 412 returning the piston 330 to top dead center (TDC). Connectivity between the connecting rod and the piston 330 translates the motion of the piston control arm 381 into the compressing motion of the piston 330 until the piston 330 reaches top dead center (TDC), as shown in FIG. 14. As shown in the combustion chamber pressure chart illustrated in FIG. 8, an ignition is activated at a timing when the piston 330 reaches or is relatively proximate to the top dead center (TDC) position as represented in the illustration presented in FIG. 15. It is noted that, as the piston 330 approaches the top dead center position (TDC) the piston return arm cam roller bearing 385 enters a top dead center retention fragment 530 of the secondary cam body peripheral edge 512 of the secondary drive cam 314. This geometric interface between the top dead center retention fragment 530 and the piston return arm cam roller bearing 385 restrains the continued pivotal motion of the piston control rocker arm assembly 380, thus limiting the upward motion of the piston 330. The ignition generates a spark from a spark plug 356, initiating a combustion sequence of the compressed fuel and air mixture within the combustion chamber 354. The combustion sequence generates pressure within the combustion chamber 354. The pressure applies a distributed force to all of surfaces defining the enclosed volume. The pressure (combustion generated pressure 490 of FIG. 21) applies a distributed force across the piston combustion surface 332 of the piston 330. The applied distributed force generates a resulting axial force 494 (FIG. 21). The resulting axial force 494 is apportioned between a normal force component 492 and a transverse or sidewall force component 496. The normal force component 492 is a portion of the resulting axial force component 494 running parallel to the central motion of travel of the piston 330 and the sidewall force 496 is a portion of the axial force component 494 running perpendicular to the central motion of travel of the piston 330. The resulting axial force 494 is transferred from the connecting rod 320 to the piston control arm 381 through the connecting rod and piston control arm connection 322.

The axial force 494 is transposed from the connecting rod and piston control arm connection 322 into a resultant force 495 based upon various factors, including an axial force moment arm 497, a resultant force moment arm 498, and a included or pressure angle 487. The axial force 494 introduces a force and an associated torque to the piston control arm 381, wherein the torque is determined by an axial force moment arm 497, or a distance extending perpendicularly from the axial force 494 to the pivot location defined by the piston control rocker arm assembly pivot member 388. The torque creates a resultant force 495 at the piston control arm cam roller bearing 382, wherein the force is a resultant of the resultant force moment arm 498, or a distance extending perpendicularly from the resultant force 495 to the pivot location defined by the piston control rocker arm assembly pivot member 388. The direction of the resultant force 495 is dependent upon a line formed between a center of rotation of the piston control arm cam roller bearing 382 and a normal contact point 499, wherein the normal contact point 499 is more distinctly defined as a point of contact between the primary drive cam 312 and the piston control arm cam roller bearing 382. It is noted, that the included or pressure angle 487 has a value of zero at top dead center (TDC) and bottom dead center (BDC). The direction of the resultant force 495 varies significantly over each rotational cycle of the system. The shape of the primary cam body peripheral edge 412 (FIG. 22) establishes the normal contact point 499 and the resulting included or pressure angle 487, wherein the included or pressure angle 487 determines the resultant force 495. A combination of the resultant force 495 and a lever arm distance 486, or a distance extending perpendicularly from the resultant force 495 to the pivot location defined by the drive cam rotational axle 316, generates a torque applied to the central drive cam assembly 310.

The applied torque causes the central drive cam assembly 310 to rotate in accordance with the drive cam assembly rotation 482. The combustion or power stroke continues while the piston control arm cam roller bearing 382 contacts the initial quarter fragment 430 and continues through the second quarter fragment 432 of the primary cam body peripheral edge 412. As the piston 330 transitions past the bottom dead center (BDC) position, the exhaust valve 374 opens enabling exhausting of spent fuel and exhaust fumes through the exhaust port 370. The piston 330 is driven upwards in a manner similar to the compression stroke. As the piston 330 is driven into the cylinder chamber 342, the piston combustion surface 332 forces the spent fuel and exhaust fumes through the exhaust port 370.

The central drive cam assembly 310 can be manufactured in any of a variety of configurations. Similarly, the piston control rocker arm assembly 380 can be manufactured in a configuration that is adapted to the selected design of the central drive cam assembly 310. For example, the central drive cam assembly 310 can include a pair of primary drive cams 312 for each secondary drive cam 314, wherein the pair of primary drive cams 312 and the secondary drive cam 314 are assembled along the central drive cam assembly 310 in sets for each cylinder. Compatibly, each piston control rocker arm assembly 380 would be manufactured including a pair of piston control arms 381 and one piston return arm 384. In another embodiment, the central drive cam assembly 310 includes one primary drive cam 312 for each pair of secondary drive cams 314, wherein the primary drive cam 312 and pair of secondary drive cams 314 are assembled along the central drive cam assembly 310 in sets for each cylinder. Compatibly, each piston control rocker arm assembly 380 would be manufactured including a piston control arm 381 and a pair of piston return arms 384.

Figure 20:
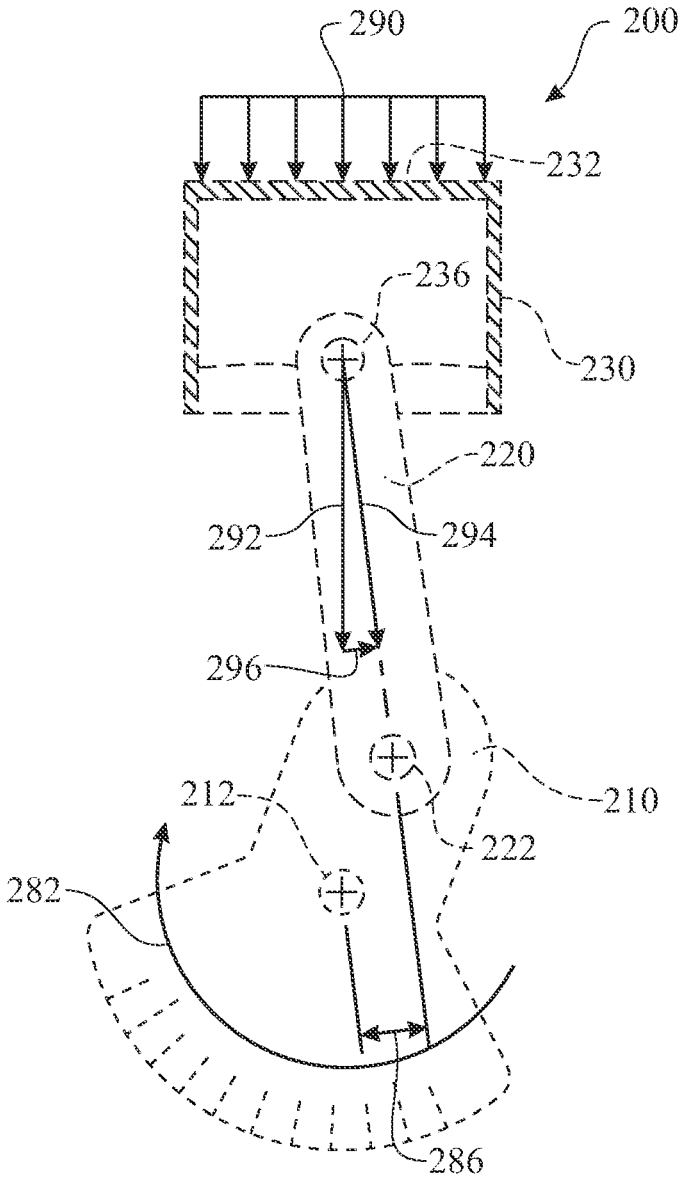
FIG. 20 presents an exemplary force diagram overlaid upon a cross section of the standard combustion engine.

An exemplary force diagram illustrating the physics during operation of the short connecting rod combustion engine 200 is presented in FIG. 20. Pressure is generated within the combustion chamber 254 (incorporated by reference from FIGS. 9 and 11), applying a distributed combustion generated pressure 290 across the piston combustion surface 232. The combustion generated pressure 290 is translated to a concentrated resulting normal force 292 applied to the connecting rod 220 through the connecting pin 236. Similar to the resulting normal force 492, the resulting normal force 292 is apportioned into an axial force component 294 and a transverse force component 296 based upon the angle of the connecting rod 220 respective to the vertical motion of the piston 230. It is understood that the angle defined between the short connecting rod combustion engine 200 and the vertical motion of the piston 330 is significantly larger than the same angle defined by the connecting rod 320 of the long connecting rod combustion engine 100. The greater the angle, the greater the resulting normal force 292 to the axial force component 294. The angle of the connecting rod 220 defines a lever arm distance 286, wherein the lever arm distance 286 is similar to the lever arm distance 486. The axial force component 294 generates and applies a torque to the crankshaft 210 based upon the axial force component 294 and a lever arm distance 286. The applied torque causes the crankshaft 210 to rotate in accordance with the crankshaft rotation 282.

The exemplary force diagrams presented in FIGS. 20 and 21 illustrate several distinguishing features. Details of the exemplary force diagram detailing operation of the drive cam operated combustion engine 300 presented in FIG. 21 were described above. The crankshaft 110, 210 design utilized in the current combustion engine configurations 100, 200 includes a significant limitation. Each of the crankpins 122 rotates about the crankshaft journal bearings 212 at an equal distance 214 resulting in a circular motion. Conversely, the utilization of drive cams 312, 314 introduce a new capability into the engine 300, where the drive cams 312, 314 enable a symmetrical or asymmetrical piston motion that can be tailored to optimize the efficiency of the engine.

Figure 29:
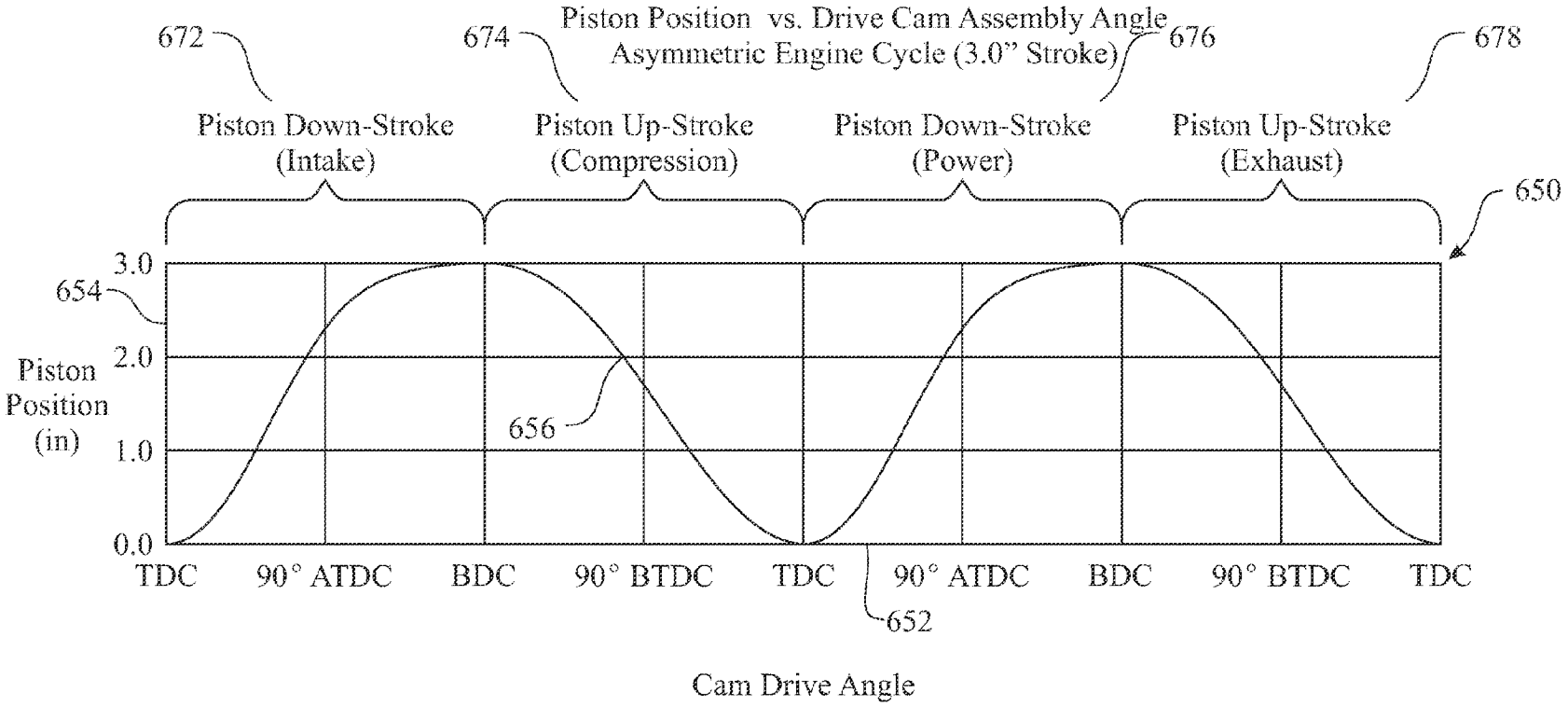
FIG. 29 presents an exemplary engine cycle diagram of the drive cam operated combustion engine configuration illustrating a relationship between a piston position and a drive cam assembly angle.
Figure 30:
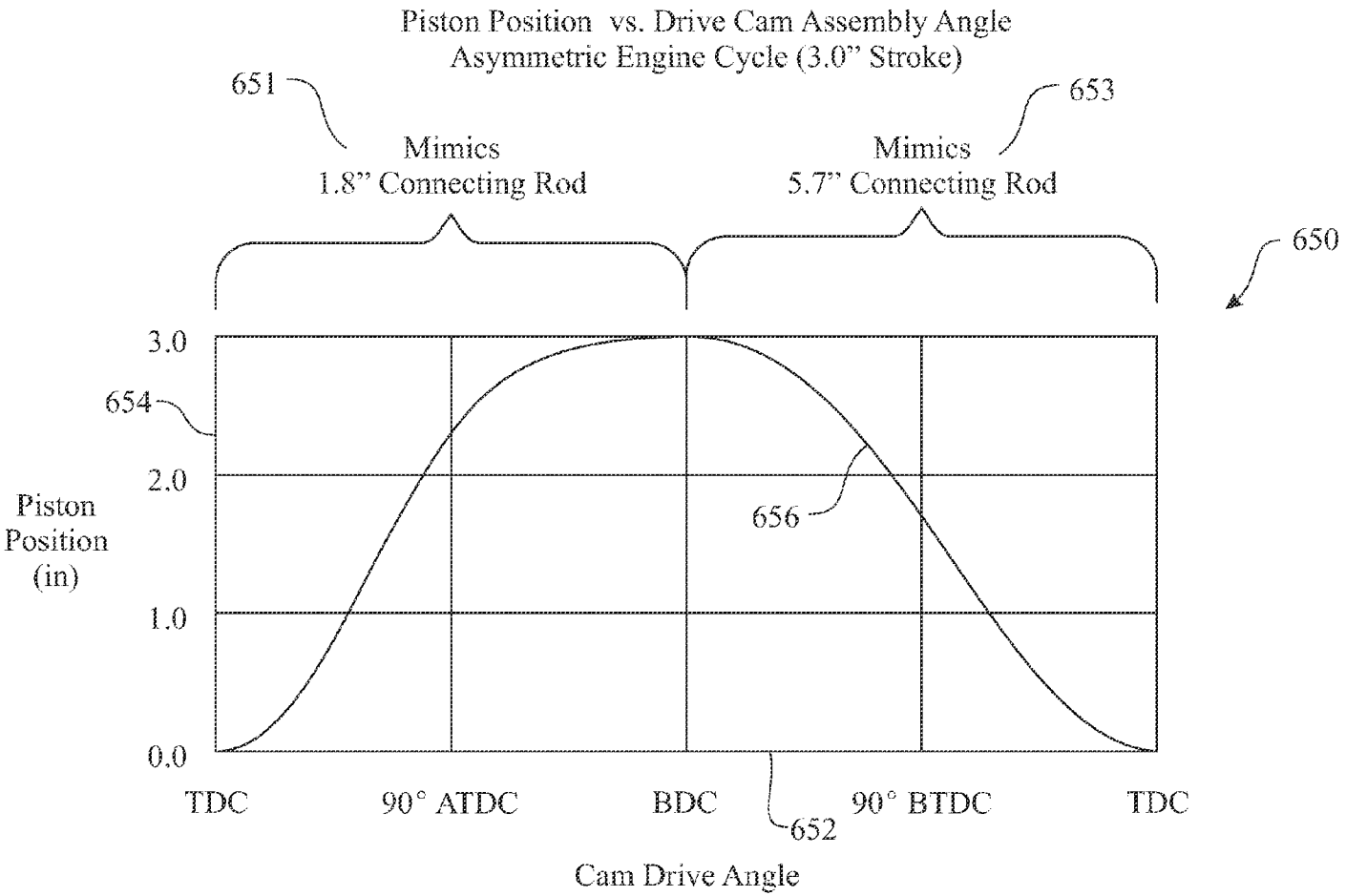
FIG. 30 presents a magnified portion of the engine cycle diagram of the drive cam operated combustion engine configuration introduced in FIG. 29, the chart detailing a relationship between a piston position and a drive cam assembly angle.

An exemplary drive cam engine component motion chart 650, illustrated in FIGS. 29 and 30, presents a piston position over engine rotational cycle 656 associated with the exemplary drive cam operated combustion engine 300. The drive cam engine component motion chart 650 segments two complete rotational cycles of the central drive cam assembly 310 into four distinct strokes: an intake stroke 672, a compression stroke segment 674, a power stroke segment 676, and an exhaust stroke segment 678. The piston position over engine rotational cycle 656 plots a piston location 348, referenced as a distance from top dead center (TDC) (charted along a vertical axis piston position axis 654), during a rotation of the central drive cam assembly 310 (charted along a horizontal axis drive cam angle axis 652). The shape of the position curve of the piston 330 as the piston 330 moves from top dead center (TDC) to bottom dead center (BDC) mimics 651 the curve of the motion of a piston 230 associated with a short connecting rod 220 as better detailed in FIG. 30, while the shape of the position curve of the piston 330 as the piston 330 moves from bottom dead center (BDC) to top dead center (TDC) mimics 653 the curve of the motion of a piston 130 associated with a long connecting rod 120.

Figure 31:
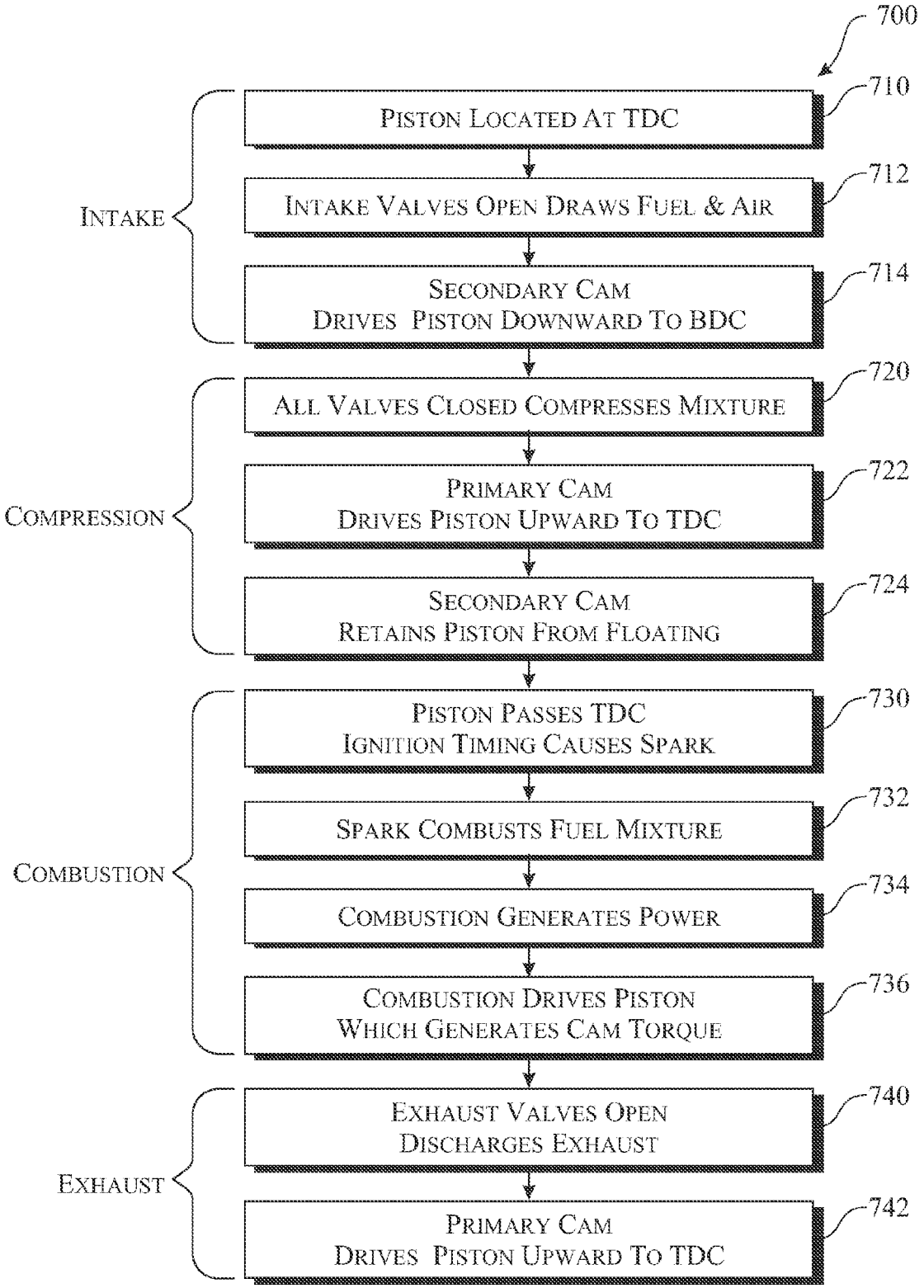
FIG. 31 presents an exemplary operational flow diagram detailing an operational steps of the drive cam operated combustion engine across the four engine cycles.

An exemplary drive cam engine cycle flow diagram 700 is presented in FIG. 31, wherein the drive cam engine cycle flow diagram 700 outlines a process flow of an operation of the drive cam operated combustion engine 300. The drive cam engine cycle flow diagram 700 initiates with an intake stroke, where the piston 330 is located at top dead center (TDC) (block 710). The intake valve 364 opens enabling passage of fuel and air flow 353 through the intake port 360 (block 712). The secondary drive cam 314 drives the piston return arm cam roller bearing 385, pivoting the piston control rocker arm assembly 380, which draws the piston control arm 381 downward. The downward motion of the piston control arm 381 draws the piston 330 away from the cylinder head assembly 350 expanding a volume within the cylinder chamber 342. As the piston 330 is drawn away from the cylinder head assembly 350, the piston combustion surface 332 creates a vacuum, drawing the fuel and air flow 353 into the volume defined by the combination of the combustion chamber 354 and the expanding cylinder chamber 342 (block 714). The intake stroke continues until the piston 330 reaches bottom dead center (BDC). As the piston 330 approaches bottom dead center (BDC), the process transitions into a compression stroke, which initiates by placing all of the valves 364, 374 associated with the respective cylinder chamber 342 into a closed position (block 720). The primary drive cam 312 applies a lifting force to the piston control arm cam roller bearing 382, which drives the piston 330 towards the combustion chamber 354, compressing the fuel and air mixture (block 722). As the piston 330 approaches top dead center (TDC), the piston return arm cam roller bearing 385 enters the top dead center retention fragment 530 of the secondary drive cam 314, limiting any inertial motion of the piston 330 to control a reversal in motion of the piston 330 (block 724). As the piston 330 passes top dead center (TDC), the ignition timing directs the spark plug 356 to generate a spark within the combustion chamber 354 (block 730) initiating a combustion stroke. The spark generated by the spark plug 356 initiates combustion of the compressed fuel and air mixture (block 732). The combustion increases a pressure within the combination of the combustion chamber 354 and the cylinder chamber 342 (block 734). The increased pressure is distributed uniformly to the surfaces defining the enclosed volume (block 734). The distributed pressure drives the only moveable surface defining the enclosed volume, or more specifically, the combustion generated pressure 490 drives the piston 330 downward converting the pressure to mechanical power (block 736). The motion of the piston 330 is translated into a torque applied to the central drive cam assembly 310 (block 736). Combustion generates power during a portion of the combustion stroke, as best illustrated by the pressure curve shown in FIG. 8. As the piston 330 approaches bottom dead center (BDC), the process transitions into an exhaust stroke, which initiates by placing the exhaust valve 374 associated with the respective cylinder chamber 342 into an open position (block 740). The primary drive cam 312 applies a lifting force to the piston control arm cam roller bearing 382, which drives the piston 330 towards the combustion chamber 354, driving spent fuel and exhaust through the exhaust port 370 (block 742). The cycles described herein are continuously repeated for each of a plurality of cylinders to generate continuous power.

Figure 32:
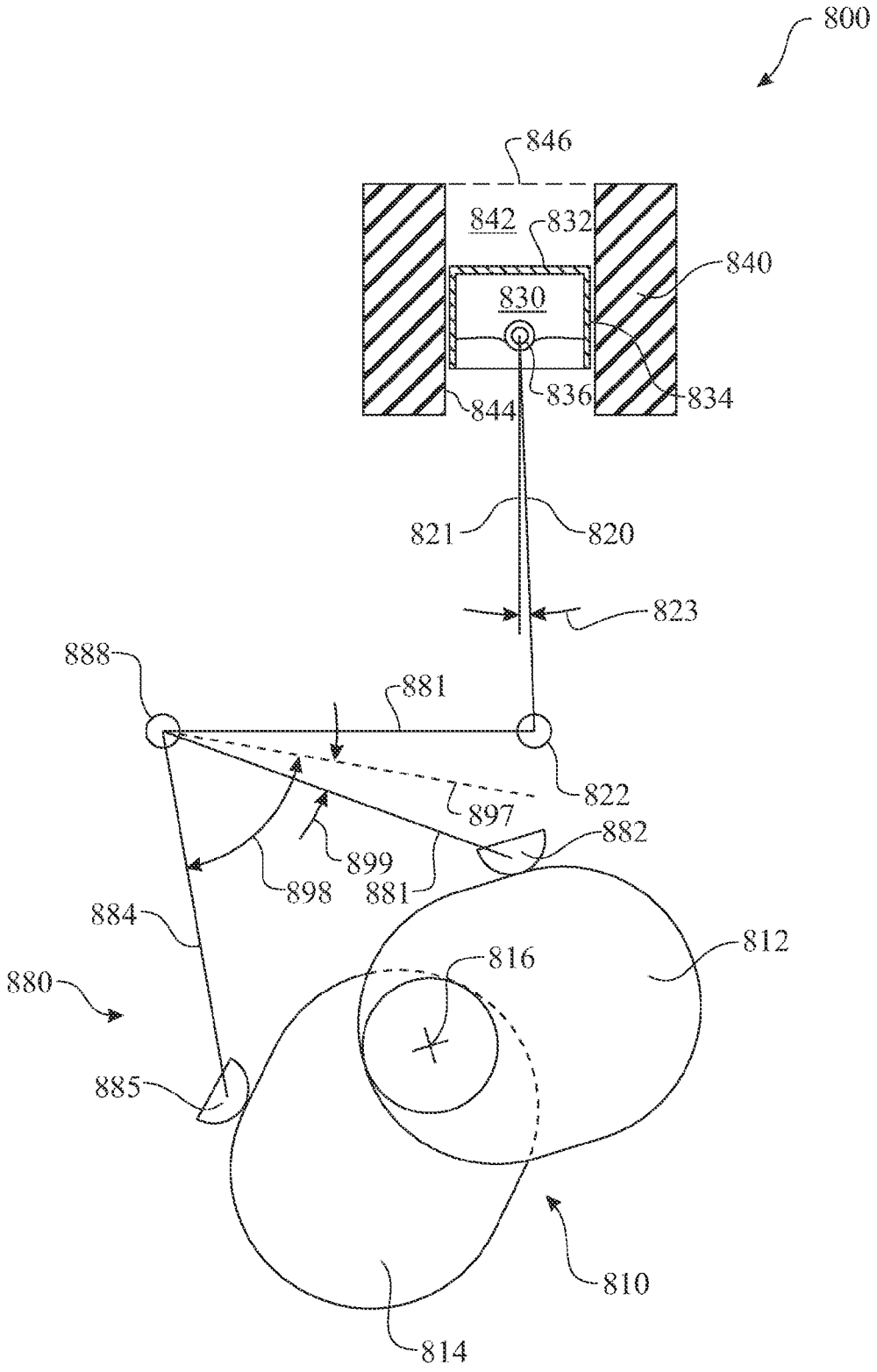
FIG. 32 presents a schematic diagram representative of a second exemplary embodiment of the drive cam operated combustion engine.
Figure 33:
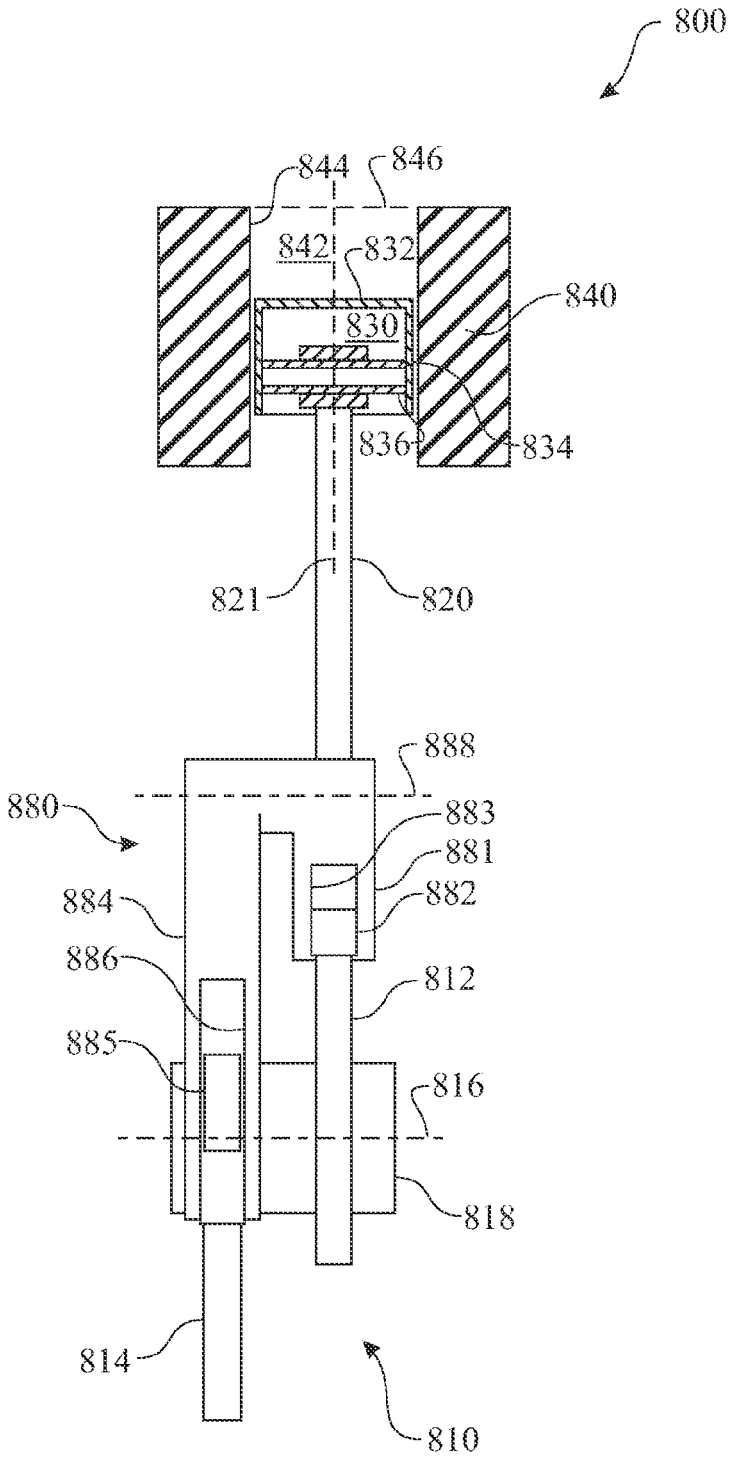
FIG. 33 presents an exemplary side view representative of the second exemplary embodiment of the drive cam operated combustion engine introduced in FIG. 13.
Figure 34:
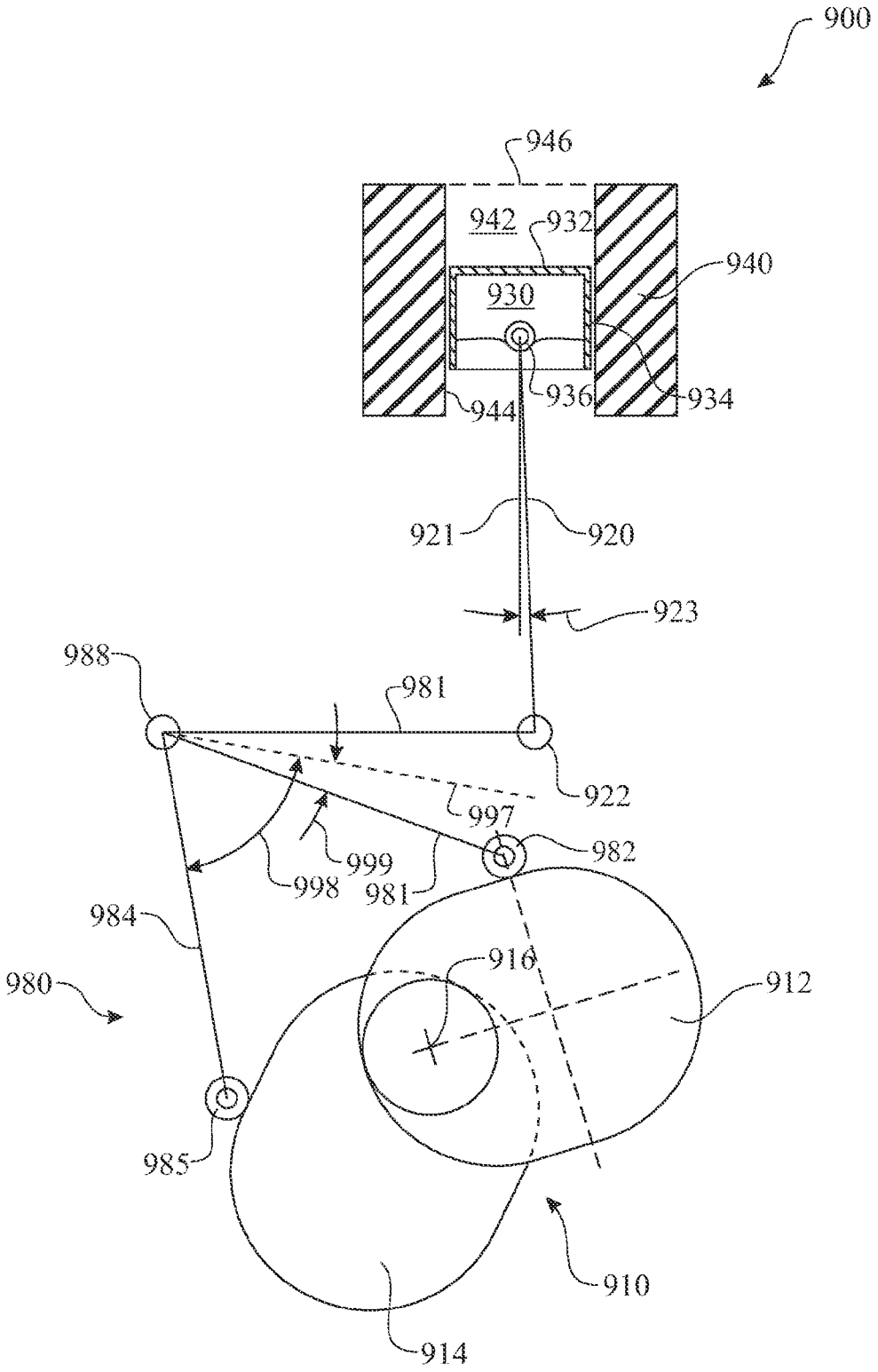
FIG. 34 presents a schematic diagram representative of a third exemplary embodiment of the drive cam operated combustion engine.
Figure 35:
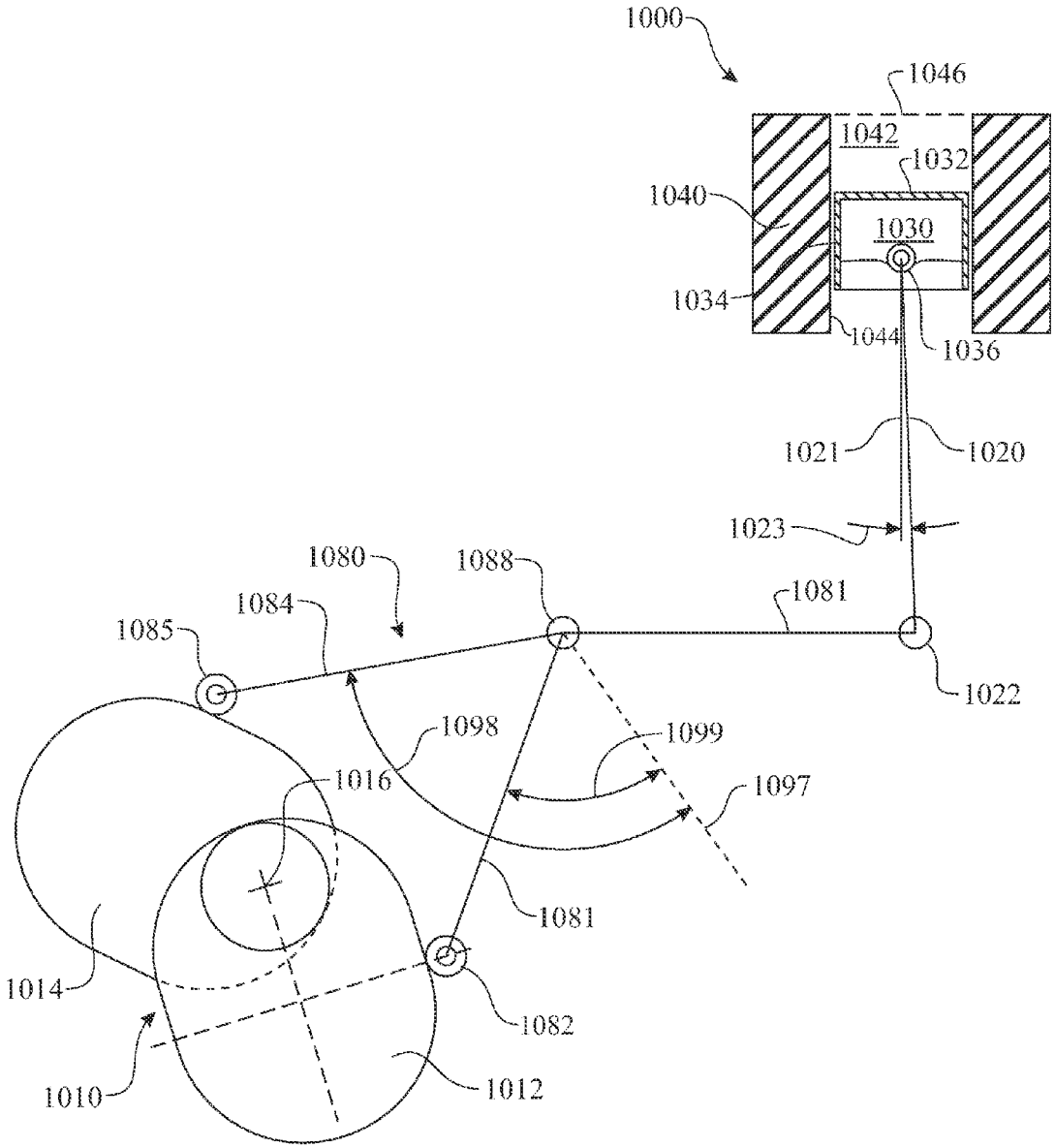
FIG. 35 presents a schematic diagram representative of a fourth exemplary embodiment of the drive cam operated combustion engine.

The drive cam operated combustion engine 300 presents one exemplary configuration of a drive cam operated combustion engine. It is understood that the exemplary configuration can be modified to obtain the same results. Examples of modified embodiments are presented is a schematic diagram format, wherein a drive cam operated combustion engine 800 is illustrated in FIGS. 32 and 33, a drive cam operated combustion engine 900 is illustrated in FIG. 34, and a drive cam operated combustion engine 1000 is illustrated in FIG. 35. Each of the modified embodiments employs the same elements, wherein the elements are provided in different configurations. Like features of the drive cam operated combustion engine 800 and the drive cam operated combustion engine 300 are numbered the same except preceded by the numeral "8". Like features of the drive cam operated combustion engine 900 and the drive cam operated combustion engine 300 are numbered the same except preceded by the numeral "9". Like features of the drive cam operated combustion engine 1000 and the drive cam operated combustion engine 300 are numbered the same except preceded by the numeral "10".

The drive cam operated combustion engine 800 is similar to the drive cam operated combustion engine 300, wherein the drive cam operated combustion engine 800 is distinguished by replacing a roller interface of the piston control arm cam bearing 382 with a fixed piston control arm cam bearing 882, wherein the fixed piston control arm cam bearing 882 slides against the peripheral edge of the primary drive cam 812 and by replacing a roller interface of the piston return arm cam bearing 385 with a fixed piston return arm cam bearing 885, wherein the fixed piston return arm cam bearing 885 slides against the peripheral edge of the secondary drive cam 814. A profile of the arrangement of the drive cam operated combustion engine 300 is presented in FIG. 33. The axial view conveys an axial relationship of between each of the arms 881, 884 of the piston control rocker arm assembly 880 and each respective drive cam 812, 814. The piston control rocker arm assembly 880 can be of any shape and size locating each of the piston control rocker arm assembly pivot member 888, connecting rod and piston control rocker arm connection 822, fixed piston control arm cam bearing 882, and fixed piston return arm cam bearing 885 providing a dynamically stable arrangement.

The drive cam operated combustion engine 900 is similar to the drive cam operated combustion engine 300, wherein the drive cam operated combustion engine 900 employs a pair of rolling members for each of the piston control arm cam bearing 982 and the piston return arm cam bearing 985. It is understood that either of the rolling elements 982, 985 can be replaced by a sliding element similar to the fixed piston control arm cam bearing 882, 885 of the drive cam operated combustion engine 800. The piston control rocker arm assembly 980 can be of any shape and size locating each of the piston control rocker arm assembly pivot member 988, connecting rod and piston control rocker arm connection 922, piston control arm cam bearing 982, and piston return arm cam bearing 985 providing a dynamically stable arrangement.

The drive cam operated combustion engine 1000 is similar to the drive cam operated combustion engine 300, with the significant distinction being a location of the drive cam rotational axle 1016. The assembly is rotated about piston control rocker arm assembly pivot member 1088 to locate drive features to a side of a centerline of the piston 1030. In the previous exemplary embodiments of the drive cam operated combustion engine 300, 800, 900, the arrangement locates the drive cam rotational axle 316, 816, 916 between the piston control rocker arm assembly pivot member 388, 888, 988 and the connecting rod and piston control arm connection 322, 822, 922. In the exemplary drive cam operated combustion engine 1000, the arrangement locates a piston control rocker arm assembly pivot member 1088 between the drive cam rotational axle 1016 and the connecting rod and crankshaft connection 1022. This exemplary embodiment illustrates a flexibility in the design of the drive cam operated combustion engine 1000, where the design of the piston control rocker arm assembly 1080 enables flexibility of the location of the central drive cam assembly 1010 and the associated drive cam rotational axle 1016.

Although the exemplary embodiment is directed towards a spark ignition engine, it is understood that the same engine configuration can be applied to other cyclically driven engines, such as a diesel engine.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

Element Description References

| Ref. No. | Description |
|---|---|
| 100 | long connecting rod combustion engine |
| 110 | crankshaft |
| 112 | crankshaft rotational axis |
| 114 | crankshaft connecting rod throw |
| 119 | timing marker |
| 120 | connecting rod |
| 122 | crankpin |
| 130 | piston |
| 132 | piston combustion surface |
| 134 | piston sidewall |
| 136 | connecting pin |
| 140 | engine block |
| 142 | cylinder chamber |
| 144 | cylinder chamber sidewall |
| 146 | cylinder chamber top dead center |
| 148 | displacement from top dead center (TDC) |
| 149 | piston stroke |
| 150 | cylinder head assembly |
| 152 | cylinder head |
| 153 | fuel and air flow |
| 154 | combustion chamber |
| 156 | spark plug |
| 160 | intake port |
| 162 | intake valve slot |
| 164 | intake valve |
| 166 | intake valve spring |
| 168 | intake valve tappet |
| 169 | intake valve cam lobe |
| 170 | exhaust port |
| 172 | exhaust valve slot |
| 173 | exhaust flow |
| 174 | exhaust valve |
| 176 | exhaust valve spring |
| 178 | exhaust valve tappet |
| 179 | exhaust valve cam lobe |
| 180 | piston motion |
| 182 | crankshaft rotation |
| 183 | crankshaft rotational angle |
| 184 | operating force |
| 186 | lever arm distance |
| 200 | short connecting rod combustion engine |
| 210 | crankshaft |
| 212 | crankshaft rotational axis |
| 214 | crankshaft connecting rod throw |

-continued

Element Description References

| Ref. No. | Description |
|---|---|
| 219 | timing marker |
| 220 | connecting rod |
| 222 | crankpin |
| 230 | piston |
| 232 | piston combustion surface |
| 234 | piston sidewall |
| 236 | connecting pin |
| 240 | engine block |
| 242 | cylinder chamber |
| 244 | cylinder chamber sidewall |
| 246 | cylinder chamber top dead center |
| 248 | displacement from top dead center (TDC) |
| 250 | cylinder head assembly |
| 252 | cylinder head |
| 254 | combustion chamber |
| 256 | spark plug |
| 260 | intake port |
| 262 | intake valve slot |
| 264 | intake valve |
| 266 | intake valve spring |
| 268 | intake valve tappet |
| 269 | intake valve cam lobe |
| 270 | exhaust port |
| 272 | exhaust valve slot |
| 274 | exhaust valve |
| 276 | exhaust valve spring |
| 278 | exhaust valve tappet |
| 279 | exhaust valve cam lobe |
| 280 | piston motion |
| 282 | crankshaft rotation |
| 283 | crankshaft rotational angle |
| 284 | operating force |
| 286 | lever arm distance |
| 290 | combustion generated pressure |
| 292 | resulting normal force |
| 294 | axial force component |
| 296 | transverse force component |
| 300 | drive cam operated combustion engine |
| 310 | central drive cam assembly |
| 312 | primary drive cam |
| 314 | secondary drive cam |
| 316 | drive cam rotational axle |
| 318 | extended drive cam spacer |
| 319 | short drive cam spacer |
| 320 | connecting rod |
| 322 | connecting rod and piston control arm connection |
| 330 | piston |
| 332 | piston combustion surface |
| 334 | piston sidewall |
| 336 | connecting pin |
| 340 | engine block |
| 342 | cylinder chamber |
| 344 | cylinder chamber sidewall |
| 346 | cylinder chamber top dead center |
| 350 | cylinder head assembly |
| 352 | cylinder head |
| 353 | fuel and air flow |
| 354 | combustion chamber |
| 356 | spark plug |
| 360 | intake port |
| 362 | intake valve slot |
| 364 | intake valve |
| 366 | intake valve spring |
| 368 | intake valve tappet |
| 369 | intake valve cam lobe |
| 370 | exhaust port |
| 372 | exhaust valve slot |
| 374 | exhaust valve |
| 376 | exhaust valve spring |
| 378 | exhaust valve tappet |
| 379 | exhaust valve cam lobe |
| 380 | piston control rocker arm assembly |
| 381 | piston control arm |

-continued

Element Description References

| Ref. No. | Description |
|---|---|
| 382 | piston control arm cam bearing |
| 383 | piston control arm primary cam clearance |
| 384 | piston return arm |
| 385 | piston return arm cam bearing |
| 386 | piston control arm secondary cam clearance |
| 387 | piston control arm counterbalance |
| 388 | piston control rocker arm assembly pivot member |
| 389 | piston return arm counterbalance |
| 390 | central drive cam assembly support member |
| 391 | central drive cam assembly support member mount |
| 392 | piston control rocker arm assembly support member |
| 393 | piston control rocker arm assembly support member mount |
| 397 | bisecting reference line |
| 398 | rocker arm drive arm to return arm angle |
| 399 | rocker arm drive arm offset angle |
| 410 | primary cam body |
| 412 | primary cam body peripheral edge |
| 414 | primary cam support aperture |
| 416 | primary cam torsional control pin |
| 418 | top dead center reference |
| 420 | bottom dead center reference |
| 430 | initial quarter fragment |
| 432 | second quarter fragment |
| 434 | bottom dead center transition |
| 436 | third quarter fragment |
| 438 | final quarter fragment |
| 480 | piston motion |
| 482 | drive cam assembly rotation |
| 485 | rocker arm assembly pivotal motion |
| 486 | lever arm distance |
| 487 | included or pressure angle |
| 490 | combustion generated pressure |
| 492 | normal force component |
| 494 | axial force |
| 495 | resultant force |
| 496 | sidewall force component |
| 497 | axial force moment arm |
| 498 | resultant force moment arm |
| 499 | normal contact point |
| 510 | secondary cam body |
| 512 | secondary cam body peripheral edge |
| 514 | secondary cam support aperture |
| 516 | secondary cam torsional control pin |
| 518 | top dead center reference |
| 520 | top dead center contact point |
| 530 | top dead center retention fragment |
| 532 | first quarter fragment |
| 534 | second quarter duration |
| 536 | third quarter fragment |
| 538 | final quarter fragment |
| 600 | long connecting rod engine component motion chart |
| 601 | short connecting rod engine component motion chart |
| 602 | crankshaft angle axis |
| 604 | piston position axis |
| 606 | piston position over engine rotational cycle |
| 616 | piston position over engine rotational cycle |
| 620 | combustion chamber pressure chart |
| 622 | crankshaft angle axis |
| 624 | combustion chamber pressure axis |
| 626 | combustion chamber pressure curve |
| 627 | effective pressure segment |
| 650 | drive cam engine component motion chart |

-continued

| Element Description References | |
|---|---|
| Ref. No. | Description |
| 652 | drive cam angle axis |
| 654 | piston position axis |
| 656 | piston position over engine rotational cycle |
| 672 | intake stroke segment |
| 674 | compression stroke segment |
| 676 | power stroke segment |
| 678 | exhaust stroke segment |
| 700 | drive cam engine cycle flow diagram |
| 710 | initial TDC piston position |
| 712 | intake valves open for injection of fuel and air |
| 714 | piston drawn downward to BDC |
| 720 | valves closed |
| 722 | piston upward motion compresses fuel and air mixture |
| 724 | piston retained from floating |
| 730 | ignition timing generates spark |
| 732 | fuel combustion |
| 734 | combustion generates power |
| 736 | combustion expansion drives piston transferring torque to cam |
| 740 | exhaust valves open for discharge of exhaust |
| 742 | piston upward motion discharges exhaust |
| 800 | drive cam operated combustion engine |
| 810 | central drive cam assembly |
| 812 | primary drive cam |
| 814 | secondary drive cam |
| 816 | drive cam rotational axle |
| 820 | connecting rod |
| 821 | piston direction of motion |
| 822 | connecting rod and piston control rocker arm connection |
| 823 | angular relation between the piston motion and connecting rod longitudinal axis |
| 830 | piston |
| 832 | piston combustion surface |
| 834 | piston sidewall |
| 836 | connecting pin |
| 840 | engine block |
| 842 | cylinder chamber |
| 844 | cylinder chamber sidewall |
| 846 | cylinder chamber top dead center |
| 880 | piston control rocker arm assembly |
| 881 | piston control arm |
| 882 | piston control arm cam bearing |
| 884 | piston return arm |
| 885 | piston return arm cam bearing |
| 888 | piston control rocker arm assembly pivot member |
| 897 | bisecting reference line |
| 898 | rocker arm drive arm to return arm angle |
| 899 | rocker arm drive arm offset angle |
| 900 | drive cam operated combustion engine |
| 910 | central drive cam assembly |
| 912 | primary drive cam |
| 914 | secondary drive cam |
| 916 | drive cam rotational axle |
| 920 | connecting rod |
| 921 | piston direction of motion |
| 922 | connecting rod and piston control rocker arm connection |
| 923 | angular relation between the piston motion and connecting rod longitudinal axis |
| 930 | piston |
| 932 | piston combustion surface |
| 934 | piston sidewall |
| 936 | connecting pin |
| 940 | engine block |
| 942 | cylinder chamber |

-continued

| Element Description References | |
|---|---|
| Ref. No. | Description |
| 944 | cylinder chamber sidewall |
| 946 | cylinder chamber top dead center |
| 980 | piston control rocker arm assembly |
| 981 | piston control arm |
| 982 | piston control arm cam bearing |
| 984 | piston return arm |
| 985 | piston return arm cam bearing |
| 988 | piston control rocker arm assembly pivot member |
| 997 | bisecting reference line |
| 998 | rocker arm drive arm to return arm angle |
| 999 | rocker arm drive arm offset angle |
| 1000 | drive cam operated combustion engine |
| 1010 | central drive cam assembly |
| 1012 | primary drive cam |
| 1014 | secondary drive cam |
| 1016 | drive cam rotational axle |
| 1020 | connecting rod |
| 1021 | piston direction of motion |
| 1022 | connecting rod and piston control rocker arm connection |
| 1023 | angular relation between the piston motion and connecting rod longitudinal axis |
| 1030 | piston |
| 1032 | piston combustion surface |
| 1034 | piston sidewall |
| 1036 | connecting pin |
| 1040 | engine block |
| 1042 | cylinder chamber |
| 1044 | cylinder chamber sidewall |
| 1046 | cylinder chamber top dead center |
| 1080 | piston control rocker arm assembly |
| 1081 | piston control arm |
| 1082 | piston control arm cam bearing |
| 1084 | piston return arm |
| 1085 | piston return arm cam bearing |
| 1088 | piston control rocker arm assembly pivot member |
| 1097 | bisecting reference line |
| 1098 | rocker arm drive arm to return arm angle |
| 1099 | rocker arm drive arm offset angle |

What is claimed is:

1. A drive cam operated combustion engine comprising:

a piston slideably assembled within a cylinder chamber of an engine block;

a central drive cam assembly comprising at least one drive cam, each of said at least one drive cam comprises a peripheral cam surface geometrically defined about a rotational axis, each cam being assembled to a rotational bearing shaft, said rotational bearing shaft being rotationally assembled to said engine block by a support element;

a piston control rocker arm assembly comprising a piston control arm and a piston return arm, wherein said piston control arm and said piston return arm are joined having an angular relation therebetween; and a connecting rod in operational communication between said piston and said piston control arm;

wherein said piston control arm is in communication with said peripheral cam surface in an arrangement driving said piston control arm upwards as a radial distance of a piston control arm contacting portion of said cam increases during rotation;

wherein said piston return arm is in communication with said cam peripheral cam surface in an arrangement driving said piston control arm downwards as a radial distance of a piston return arm contacting portion of said cam increases during rotation, wherein said peripheral cam surface of said at least one drive cam has a shape causing:

a) said piston to cycle through a compression stroke and combustion stroke during a first full rotation thereof, and b) said piston to cycle through an exhaust stroke and an intake stroke during a second full rotation thereof.

2. A drive cam operated combustion engine as recited in claim 1, said at least one drive cam further comprising a primary drive cam and a secondary drive cam, wherein said primary drive cam is in operable communication with said piston control arm, wherein said secondary drive cam is in operable communication with said piston return arm.

3. A drive cam operated combustion engine as recited in claim 2, said secondary drive cam further comprising a top dead center retention feature, wherein said top dead center retention feature operationally restrains said piston against inertial momentum when said piston transitions from a compression direction to a combustion direction at top dead center (TDC).

4. A drive cam operated combustion engine as recited in claim 1, wherein said peripheral cam surface of said drive cam assembly is shaped to maintain a position of said piston in at least one of:

at top dead center (TDC) over a prolonged period of time, and at bottom dead center (BDC) over a prolonged period of time.

5. A drive cam operated combustion engine as recited in claim 1, wherein said peripheral cam surface of said drive cam assembly is asymmetrically shaped providing one of:

an upward motion of said piston during a rotational motion of said central drive cam assembly that is greater than 180° and a downward motion of said piston during a rotational motion of said central drive cam assembly that is less than 180°, or said upward motion of said piston during a rotational motion of said central drive cam assembly that is less than 180° and said downward motion of said piston during a rotational motion of said central drive cam assembly that is greater than 180°.

6. A drive cam operated combustion engine as recited in claim 1, wherein said peripheral cam surface of said drive cam assembly is designed to replicate a cyclical motion of a short connecting rod engine configuration during a first portion of each rotation of said central cam drive assembly and a cyclical motion of a long connecting rod engine configuration during a second portion of each rotation of said central cam drive assembly.

7. A drive cam operated combustion engine as recited in claim 1, further comprising at least one counterweight, wherein said at least one counterweight provides static and dynamic balancing to at least one of:

said central drive cam assembly, said at least one drive cam, said piston control rocker arm assembly, said piston control arm, and said piston return arm.

8. A drive cam operated combustion engine as recited in claim 1, further comprising at least one roller bearing, wherein said at least roller bearing is integrated in at least one of:

providing a rolling contact interface between said piston control arm and a contacting peripheral cam surface of said at least one drive cam, providing a rolling contact interface between said piston return arm and a contacting peripheral cam surface of said at least one drive cam, at a piston control rocker arm assembly pivot location of said piston control rocker arm assembly, and providing a friction reduced interface between said piston control arm and an associated end of said connecting rod.

9. A drive cam operated combustion engine as recited in claim 1, said at least one drive cam further comprising at least one primary drive cam and at least one secondary drive cam, said piston control rocker arm assembly further comprising at least one said piston control arm and at least one said piston return arm, wherein a quantity of said at least one primary drive cam and a quantity of said at least one said piston control arm are the same, wherein a quantity of said at least one secondary drive cam and a quantity of said at least one said piston return arm are the same, wherein each primary drive cam of said at least one primary drive cam is in operable communication with each respective piston control arm of said at least one said piston control arm, and wherein each secondary drive cam of said at least one secondary drive cam is in operable communication with each respective piston return arm of said at least one said piston return arm.

10. A drive cam operated combustion engine comprising a series of combustion propulsion arrangements, each combustion propulsion arrangement includes:

a piston slideably assembled within a cylinder chamber of an engine block;

a central drive cam assembly comprising at least one drive cam, each of said at least one drive cam comprises a peripheral cam surface geometrically defined about a rotational axis, each cam being assembled to a rotational bearing shaft, said rotational bearing shaft being rotationally assembled to said engine block by a support element;

a piston control rocker arm assembly comprising a piston control arm and a piston return arm, wherein said piston control arm and said piston return arm are joined having an angular relation therebetween; and a connecting rod in operational communication between said piston and said piston control arm;

wherein said piston control arm is in communication with said peripheral cam surface in an arrangement driving said piston control arm upwards as a radial distance of a piston control arm contacting portion of said cam increases during rotation;

wherein said piston return arm is in communication with said cam peripheral cam surface in an arrangement driving said piston control arm downwards as a radial distance of a piston return arm contacting portion of said cam increases during rotation, wherein said peripheral cam surface of said at least one drive cam has a shape causing:

a) said piston to cycle through a compression stroke and combustion stroke during a first full rotation thereof, and b) said piston to cycle through an exhaust stroke and an intake stroke during a second full rotation thereof.

11. A drive cam operated combustion engine as recited in claim 10, said at least one drive cam further comprising a primary drive cam and a secondary drive cam, wherein said primary drive cam is in operable communication with said piston control arm, wherein said secondary drive cam is in operable communication with said piston return arm.

12. A drive cam operated combustion engine as recited in claim 11, said secondary drive cam further comprising a top dead center retention feature, wherein said top dead center retention feature operationally restrains said piston against inertial momentum when said piston transitions from a compression direction to a combustion direction at top dead center (TDC).

13. A drive cam operated combustion engine as recited in claim 10, wherein said peripheral cam surface of said drive cam assembly is shaped to maintain a position of said piston in at least one of:

at top dead center (TDC) over a prolonged period of time, and at bottom dead center (BDC) over a prolonged period of time.

14. A drive cam operated combustion engine as recited in claim 10, wherein said peripheral cam surface of said drive cam assembly is asymmetrically shaped providing one of:

an upward motion of said piston during a rotational motion of said central drive cam assembly that is greater than 180° and a downward motion of said piston during a rotational motion of said central drive cam assembly that is less than 180°, or said upward motion of said piston during a rotational motion of said central drive cam assembly that is less than 180° and said downward motion of said piston during a rotational motion of said central drive cam assembly that is greater than 180°.

15. A drive cam operated combustion engine as recited in claim 10, wherein said peripheral cam surface of said drive cam assembly is designed to replicate a cyclical motion of a short connecting rod engine configuration during a first portion of each rotation of said central cam drive assembly and a cyclical motion of a long connecting rod engine configuration during a second portion of each rotation of said central cam drive assembly.

16. A drive cam operated combustion engine as recited in claim 10, further comprising at least one counterweight, wherein said at least one counterweight provides static and dynamic balancing to at least one of:

said central drive cam assembly, said at least one drive cam, said piston control rocker arm assembly, said piston control arm, and said piston return arm.

17. A drive cam operated combustion engine as recited in claim 10, further comprising at least one roller bearing, wherein said at least roller bearing is integrated in at least one of:

providing a rolling contact interface between said piston control arm and a contacting peripheral cam surface of said at least one drive cam, providing a rolling contact interface between said piston return arm and a contacting peripheral cam surface of said at least one drive cam, at a piston control rocker arm assembly pivot location of said piston control rocker arm assembly, and providing a friction reduced interface between said piston control arm and an associated end of said connecting rod.

18. A drive cam operated combustion engine as recited in claim 10, said at least one drive cam further comprising at least one primary drive cam and at least one secondary drive cam, said piston control rocker arm assembly further comprising at least one said piston control arm and at least one said piston return arm, wherein a quantity of said at least one primary drive cam and a quantity of said at least one said piston control arm are the same, wherein a quantity of said at least one secondary drive cam and a quantity of said at least one said piston return arm are the same, wherein each primary drive cam of said at least one primary drive cam is in operable communication with each respective piston control arm of said at least one said piston control arm, and wherein each secondary drive cam of said at least one secondary drive cam is in operable communication with each respective piston return arm of said at least one said piston return arm.

19. A drive cam operated combustion engine comprising:

a piston slideably assembled within a cylinder chamber of an engine block;

a cylinder head assembly comprising:

at least one intake port, at least one intake valve, wherein each of said at least one intake valve is in operational communication with each respective intake port of said at least one intake port, an intake valve operational mechanism, wherein said intake valve operational mechanism oscillates each of said at least one intake valve between an open position and a closed position, at least one exhaust port, at least one exhaust valve, wherein each of said at least one exhaust valve is in operational communication with each respective exhaust port of said at least one exhaust port, an exhaust valve operational mechanism, wherein said exhaust valve operational mechanism oscillates each of said at least one exhaust valve between an open position and a closed position;

a central drive cam assembly comprising at least one drive cam, each of said at least one drive cam comprises a peripheral cam surface geometrically defined about a rotational axis, each cam being assembled to a rotational bearing shaft, said rotational bearing shaft being rotationally assembled to said engine block by a support element;

a piston control rocker arm assembly comprising a piston control arm and a piston return arm, wherein said piston control arm and said piston return arm are joined having an angular relation therebetween; and a connecting rod in operational communication between said piston and said piston control arm;

wherein said piston control arm is in communication with said peripheral cam surface in an arrangement driving said piston control arm upwards as a radial distance of a piston control arm contacting portion of said cam increases during rotation;

wherein said piston return arm is in communication with said cam peripheral cam surface in an arrangement driving said piston control arm downwards as a radial distance of a piston return arm contacting portion of said cam increases during rotation, wherein said peripheral cam surface of said at least one drive cam has a shape causing:

a) said piston to cycle through a compression stroke and combustion stroke during a first full rotation thereof, and b) said piston to cycle through an exhaust stroke and an intake stroke during a second full rotation thereof.

20. A drive cam operated combustion engine as recited in claim 19, said at least one drive cam further comprising a primary drive cam and a secondary drive cam, wherein said primary drive cam is in operable communication with said piston control arm, wherein said secondary drive cam is in operable communication with said piston return arm.

21. A drive cam operated combustion engine as recited in claim 20, said secondary drive cam further comprising a top dead center retention feature, wherein said top dead center retention feature operationally restrains said piston against inertial momentum when said piston transitions from a compression direction to a combustion direction at top dead center (TDC).

22. A drive cam operated combustion engine as recited in claim 19, wherein said peripheral cam surface of said drive cam assembly is shaped to maintain a position of said piston in at least one of:

at top dead center (TDC) over a prolonged period of time, and at bottom dead center (BDC) over a prolonged period of time.

23. A drive cam operated combustion engine as recited in claim 19, wherein said peripheral cam surface of said drive cam assembly is asymmetrically shaped providing one of:

an upward motion of said piston during a rotational motion of said central drive cam assembly that is greater than 180° and a downward motion of said piston during a rotational motion of said central drive cam assembly that is less than 180°, or said upward motion of said piston during a rotational motion of said central drive cam assembly that is less than 180° and said downward motion of said piston during a rotational motion of said central drive cam assembly that is greater than 180°.

24. A drive cam operated combustion engine as recited in claim 19, wherein said peripheral cam surface of said drive cam assembly is designed to replicate a cyclical motion of a short connecting rod engine configuration during a first portion of each rotation of said central cam drive assembly and a cyclical motion of a long connecting rod engine configuration during a second portion of each rotation of said central cam drive assembly.

25. A drive cam operated combustion engine as recited in claim 19, further comprising at least one counterweight, wherein said at least one counterweight provides static and dynamic balancing to at least one of:

said central drive cam assembly, said at least one drive cam, said piston control rocker arm assembly, said piston control arm, and said piston return arm.

26. A drive cam operated combustion engine as recited in claim 19, said at least one drive cam further comprising at least one primary drive cam and at least one secondary drive cam, said piston control rocker arm assembly further comprising at least one said piston control arm and at least one said piston return arm, wherein a quantity of said at least one primary drive cam and a quantity of said at least one said piston control arm are the same, wherein a quantity of said at least one secondary drive cam and a quantity of said at least one said piston return arm are the same, wherein each primary drive cam of said at least one primary drive cam is in operable communication with each respective piston control arm of said at least one said piston control arm, and wherein each secondary drive cam of said at least one secondary drive cam is in operable communication with each respective piston return arm of said at least one said piston return arm.

* * * * *